US010342314B2

(12) United States Patent
Byun

(10) Patent No.: US 10,342,314 B2
(45) Date of Patent: Jul. 9, 2019

(54) LIQUID COSMETICS CASE

(71) Applicant: Young-Kwang Byun, Seoul (KR)

(72) Inventor: Young-Kwang Byun, Seoul (KR)

( * ) Notice: Subject to any disclaimer, the term of this patent is extended or adjusted under 35 U.S.C. 154(b) by 141 days.

(21) Appl. No.: 15/459,944

(22) Filed: Mar. 15, 2017

(65) Prior Publication Data

US 2018/0116369 A1 May 3, 2018

(30) Foreign Application Priority Data

Nov. 2, 2016 (KR) ..... 10-2016-0145323
Dec. 23, 2016 (KR) ..... 10-2016-0178009

(51) Int. Cl.

| | |
|---|---|
| ***B65D 47/24*** | (2006.01) |
| ***A45D 34/04*** | (2006.01) |
| ***B65D 83/28*** | (2006.01) |
| ***B65D 83/54*** | (2006.01) |
| *B65D 83/40* | (2006.01) |
| *B65D 83/64* | (2006.01) |

(52) U.S. Cl.

CPC ..... *A45D 34/04* (2013.01); *B65D 83/285* (2013.01); *B65D 83/54* (2013.01); *B65D 47/24* (2013.01); *B65D 83/40* (2013.01); *B65D 83/64* (2013.01)

(58) Field of Classification Search

CPC ..... B65D 47/24; B65D 47/241; B65D 47/242
USPC ..... 401/263, 266, 280, 281; 222/554
See application file for complete search history.

(56) References Cited

U.S. PATENT DOCUMENTS 8,939,670 B2 * 1/2015 Choi ..... A45D 34/042 222/554

FOREIGN PATENT DOCUMENTS

KR 100702621 3/2007
KR 2020100003887 2/2011

* cited by examiner

*Primary Examiner* — David J Walczak
*Assistant Examiner* — Joshua R Wiljanen
(74) *Attorney, Agent, or Firm* — Kaplan Breyer Schwarz, LLP

(57) ABSTRACT

A liquid cosmetics case in which the number of parts is reduced and a liquid content is discharged by opening or closing a valve nozzle through rotation. The liquid cosmetics case includes a case body having an opened upper portion and filled with a liquid content therein, a solder unit coupled to the opened upper portion of the case body and having a discharge tube in which a discharge hole is defined in a central portion thereof, a valve unit inserted into the discharge tube to open or close the discharge hole according to elevation of a valve nozzle, a valve actuator unit rotatably coupled to an upper portion of the solder unit to convert the rotation movement into a vertical linear movement of the valve nozzle and open or close the discharge hole, and an applicator unit coupled to an upper end of the valve actuator unit.

14 Claims, 24 Drawing Sheets

LIQUID COSMETICS CASE

CROSS-REFERENCE TO RELATED APPLICATION

This application claims priority to and the benefit of Korean Patent Application Nos. 10-2016-0145323, filed on Nov. 2, 2016, and 10-2016-0178009, filed on Dec. 23, 2016, the disclosure of which are incorporated herein by reference in their entirety.

FIELD OF THE INVENTION

The present invention relates to a cosmetics case, and more particularly, to a liquid cosmetics case that is rotated to open a valve nozzle, thereby discharging liquid contents.

BACKGROUND OF THE INVENTION

In general, liquid cosmetics for facial makeup are contained in a case, and then, when applying makeup, the liquid content within the case is discharged for use.

In the related art, a button type and rotary type have been mainly applied in a manner for discharging a liquid content within a liquid cosmetics case.

The button type liquid cosmetics case has a structure in which an applicator having a button shape is provided on an upper or side portion of a case body, and the button is repeatedly pushed to discharge a liquid content within the case. However, when the button is installed on the upper or side portion of the case body, the case may be complicated in structure, the number of components may increase to raise manufacturing costs, and malfunction may occur.

Also, when the button is applied to a lower portion of the case body as another example of the button type liquid cosmetics case, the total length of the case body may increase to cause deterioration in outer appearance and inconvenience in use.

The rotary type liquid cosmetics case has a structure in which the case is screw-rotated within the body to move, thereby discharging a liquid content within the case. However, the rotary type liquid cosmetics case may be applied to only contents having viscosity, and since a discharging portion is always opened, the content may be discharged regardless of the intension of a user to cause a limitation in airtightness.

Also, since the content is discharged regardless of the user's intension, the user has a difficulty in applying cosmetics, and the user's hand is stained with the cosmetics.

Also, when a cosmetic pad is disposed on an upper portion of the applicator through which the content is discharged, an edge border of the top surface of the applicator protrudes by a predetermined height to form a circular tube shape so as to form a pad seating groove in which the cosmetic pad is inserted into and seated on a top surface of the applicator. Thus, when the cosmetic pad is inserted and stored into the pad seating groove or is used by staining the content discharged through the discharge hole defined in the top surface of the applicator, the content may remain on the inside of the circular tube-shaped rim. As a result, the remaining content may allow the cosmetics case to be dirty and also act as causes of pollution and germ propagation.

PRIOR ART DOCUMENTS (Patent Document 1) Korean Patent Registration No. 10-0702621

(Patent Document 2) Korean Utility Model Publication No. 20-2010-0003887

SUMMARY OF THE INVENTION

A technical object to be achieved by the present invention is to provide a liquid cosmetics case in which the number of parts is reduced to be simplified in structure, and a valve nozzle is switched by rotation to discharge a liquid content.

Another object of the present invention is to provide a liquid cosmetics case in which a cosmetic pad is maintained to seal a discharge hole of an applicator by using a magnetic property and thereby to prevent a content from being volatilized, and which is capable of preventing the content from remaining on a border of the applicator.

To solve the foregoing objects, a liquid cosmetics case includes: a case body having an opened upper portion and filled with a liquid content therein; a solder unit coupled to the opened upper portion of the case body and having a discharge tube in which a discharge hole is defined in a central portion thereof; a valve unit inserted into the discharge tube to open or close the discharge hole according to elevation of a valve nozzle; a valve actuator unit rotatably coupled to an upper portion of the solder unit to convert the rotation movement into a vertical linear movement of the valve nozzle and open or close the discharge hole, wherein, when the valve nozzle descends by the rotation, the valve actuator unit opens the discharge hole to discharge the content, and when the valve nozzle ascends, the valve actuator unit closes the discharge hole to block the discharge of the content; and an applicator unit coupled to an upper end of the valve actuator unit to discharge the content discharged by the rotation of the valve actuator unit through a plurality of fine discharge holes.

The solder unit may include: a solder body fitted and coupled to the outside of an upper end of the case body; and a discharge tube having a circular tube shape with an opened upper portion in a central portion of the solder body, integrated with a valve housing therein, and having a lower portion in which the discharge hole is defined.

The valve unit may include: a valve housing extending in a circular tube shape with an opened upper portion and integrated with an inner lower portion of the discharge tube and having a lower end communicating with the discharge hole; a valve nozzle installed vertically movable by passing through the discharge hole in a state of being inserted into the valve housing, having a nozzle hole therein and an inflow hole, which is connected to the nozzle hole to introduce the content into the nozzle hole, in a side thereof; a switching member movably fitted outside valve nozzle, wherein, when the valve nozzle moves toward the discharge hole, the switching member is pushed to a side opposite to the discharge hole by a pressure of the content introduced between the valve housing and the valve nozzle, and when the valve nozzle moves toward a side opposite to the discharge hole, the switching member is pushed by the valve nozzle to return its original state; and a valve cap coupled to the valve housing to pass through an upper portion of the valve nozzle.

The valve actuator unit may include: a first cam part, which is fitted into an upper portion of the valve cap, through which the valve nozzle passes a central portion thereof, and in which a plurality of inclined sawteeth at a predetermined interval on an outer surface thereof along a circumferential direction; an elastic member installed to elastically support the first cam part with respect to the valve cap; and a rotatable cap, which is rotatably fitted and coupled outside the solder unit, in which an upper end of the valve nozzle passes through a central portion to a top surface thereof, and which has a circular tube shape in an inner lower portion of the central portion of the top surface thereof and is integrated with a second cam part having a plurality of cam protrusions at a predetermined interval on an inner surface thereof along a circumferential direction to correspond to the inclined sawteeth, wherein, when the rotatable cap is rotated, the cam protrusions of the second cam part may be rotated to vertically move the first cam part by the inclined contact with the inclined sawteeth of the first cam part and elevate the valve nozzle connected to the first cam part, thereby opening or closing the discharge hole.

Each of the inclined sawteeth may have an upward inclined surface and a downward inclined surface with respect to the rotation direction of the rotatable cap, and when the rotatable cap is rotated, the camp protrusions of the second cam part may come into contact with the upward inclined surface and move the first cam part downward to open the discharge hole while the valve nozzle moves toward the discharge hole, and the cam protrusions of the second cam part may pass through the upward inclined surface to come into contact with the downward inclined surface and move the first cam part upward, thereby closing the discharge hole while the valve nozzle moves to a side opposite to the discharge hole.

At least one rotation prevention protrusion may protrude from an outer surface of the first cam part, and at least one elevation guide groove may be defined in an inner surface of the discharge tube of the solder unit in a longitudinal direction so that the rotation prevention protrusion is inserted into the elevation guide groove, and when the rotatable cap is rotated, the rotation prevention protrusion may move along the elevation guide groove and be elevated to move within the discharge tube without rotating the first cam part.

The rotatable cap may include: a rotation coupling part having a hollow circular tube shape and rotatably fitted and coupled outside of the solder unit; a lid coupling part which extends from an upper end of the rotation coupling part and has inner and outer diameters less than those of the rotation coupling part and in which a case lid is detachably fitted into an outer surface thereof; an applicator holder coupling part which extends to protrude from a top surface of the lid coupling part and has a discharge hole in a central portion thereof and in which an applicator holder is detachably fitted into an outer surface thereof; and a second cam part integrally formed in a circular tube shape on an inner lower portion of a central portion of the top surface of the lid coupling part.

The rotatable cam may further include a sealing member inserted into and coupled to the discharge hole of the applicator holder coupling part and having a through hole in a central portion thereof, wherein the upper end of the valve nozzle may be inserted to pass through the through hole of the sealing member, thereby preventing a liquid from leaking between the valve nozzle and the discharge hole by the sealing member.

The applicator unit may include: an applicator holder fitted into and coupled to the applicator holder coupling part and having a discharge hole in a central portion thereof so as to be connected to the nozzle hole of the valve nozzle through the through hole of the sealing member; an absorption pad installed on a top surface of the applicator holder to absorb and keep the content discharged through the discharge hole of the applicator holder; and a cosmetic pad fixed to the applicator holder in a state of covering a top surface of the absorption pad and having a plurality of fine discharge holes to finely discharge the content absorbed to the absorption pad.

The liquid cosmetics case may further include a cosmetic puff unit detachably installed on an upper portion of the applicator unit by a magnetic property to maintain sealing of the fine discharge holes of the applicator unit when attached by the magnetic property.

A first magnetic body or a metal member may be built in the applicator unit, and a second magnetic body having a polarity opposite to that of the first magnetic body may be built in the cosmetic puff unit to allow the cosmetic puff unit to be attached to the applicator unit by magnetic attractive force between the first magnetic body and the second magnetic body or between the metal member and the second magnetic body.

The applicator unit may include: an applicator holder, which is installed on an upper portion of the rotatable cap and includes a cylindrical magnetic housing having a first magnet insertion groove in a center of a lower portion of a top surface thereof and in which a plurality of fine discharge holes passing through a top surface of the magnet housing; a first magnetic body or a metal member inserted into the first magnet insertion groove; and a magnet cover, which has an upper portion inserted and coupled inside the magnet housing to cover the first magnetic body or the metal member and a lower portion inserted and coupled outside the applicator holder coupling part and in which a plurality of discharge connection holes in a top surface thereof to correspond to the fine discharge holes while being connected to the nozzle hole of the valve nozzle through the through hole of the applicator holder coupling part.

The applicator unit may further include a sealing member, which has an upper portion inserted inside the magnet cover and a lower portion inserted into the discharge hole of the applicator holder coupling part and in which a through hole is defined in a central portion thereof, and the upper end of the valve nozzle may be inserted to pass through the through hole of the sealing member to prevent the liquid from leaking between the valve nozzle and the discharge hole.

The cosmetic puff unit may include: a handle holder in which a handle is disposed on an upper portion thereof, and a second magnet insertion groove is defined in a center of a lower portion thereof; a second magnetic body inserted into the second magnet insertion grove; and a cosmetic pad installed to surround the lower portion of the handle holder in a state in which the second magnetic body is inserted into the second magnet insertion groove and coming into contact with a top surface of the applicator holder to absorb and keep the content discharged through the fine discharge holes.

The cosmetic puff unit is disposed between the handle holder and the cosmetic pad and may further include the sponge pad that gives electricity to the cosmetic pad.

An edge of border of a top surface of the applicator holder may have a rounded curve to correspond to a curve of an edge of a bottom surface of the cosmetic pad to improve adhesion when coming into contact with the cosmetic pad and prevent the discharged content from remaining on the rounded border of the applicator holder.

DETAILED DESCRIPTION

A liquid cosmetics case according to preferred embodiments of the present invention will be described below in detail with reference to the accompanying drawings. For reference, detailed descriptions related to well-known functions or configurations will be ruled out in order not to unnecessarily obscure subject matters of the present invention.

Figure 1:
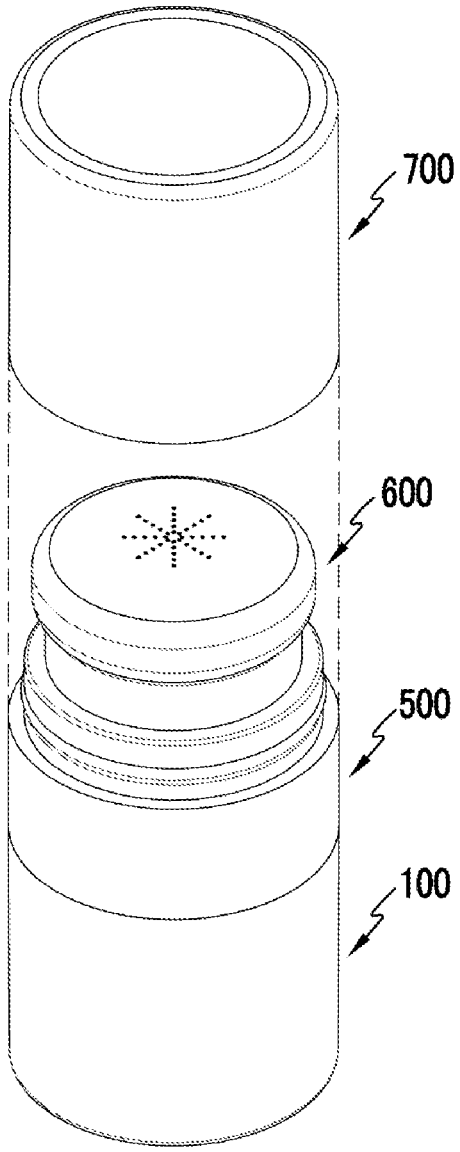
FIG. 1 is a perspective view of a liquid cosmetics case according to an embodiment of the present invention.
Figure 2:
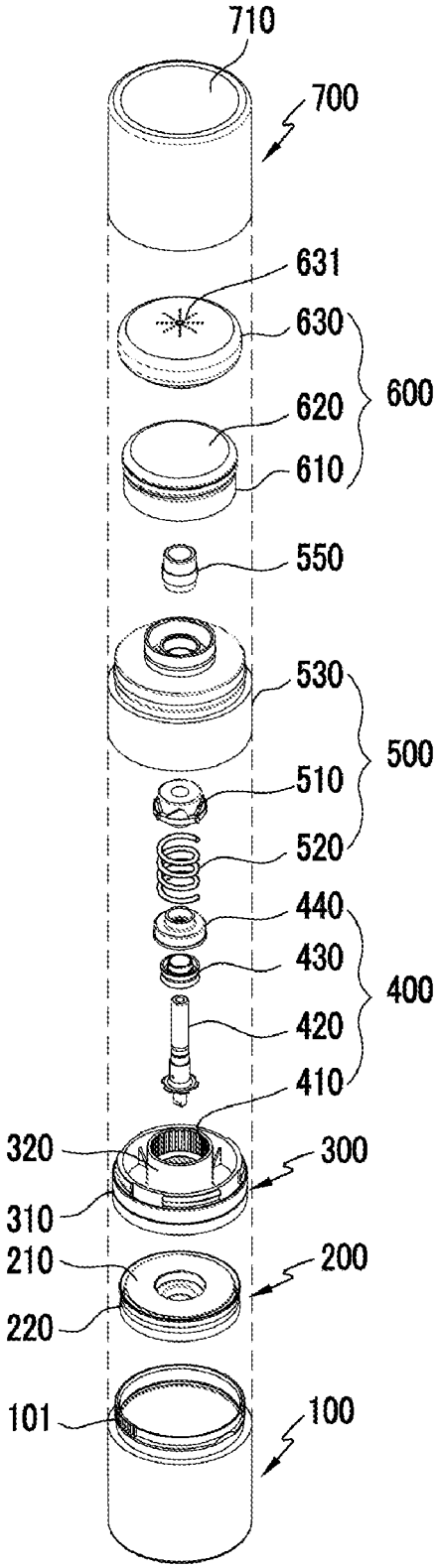
FIG. 2 is an exploded perspective view of FIG. 1.
Figure 3:
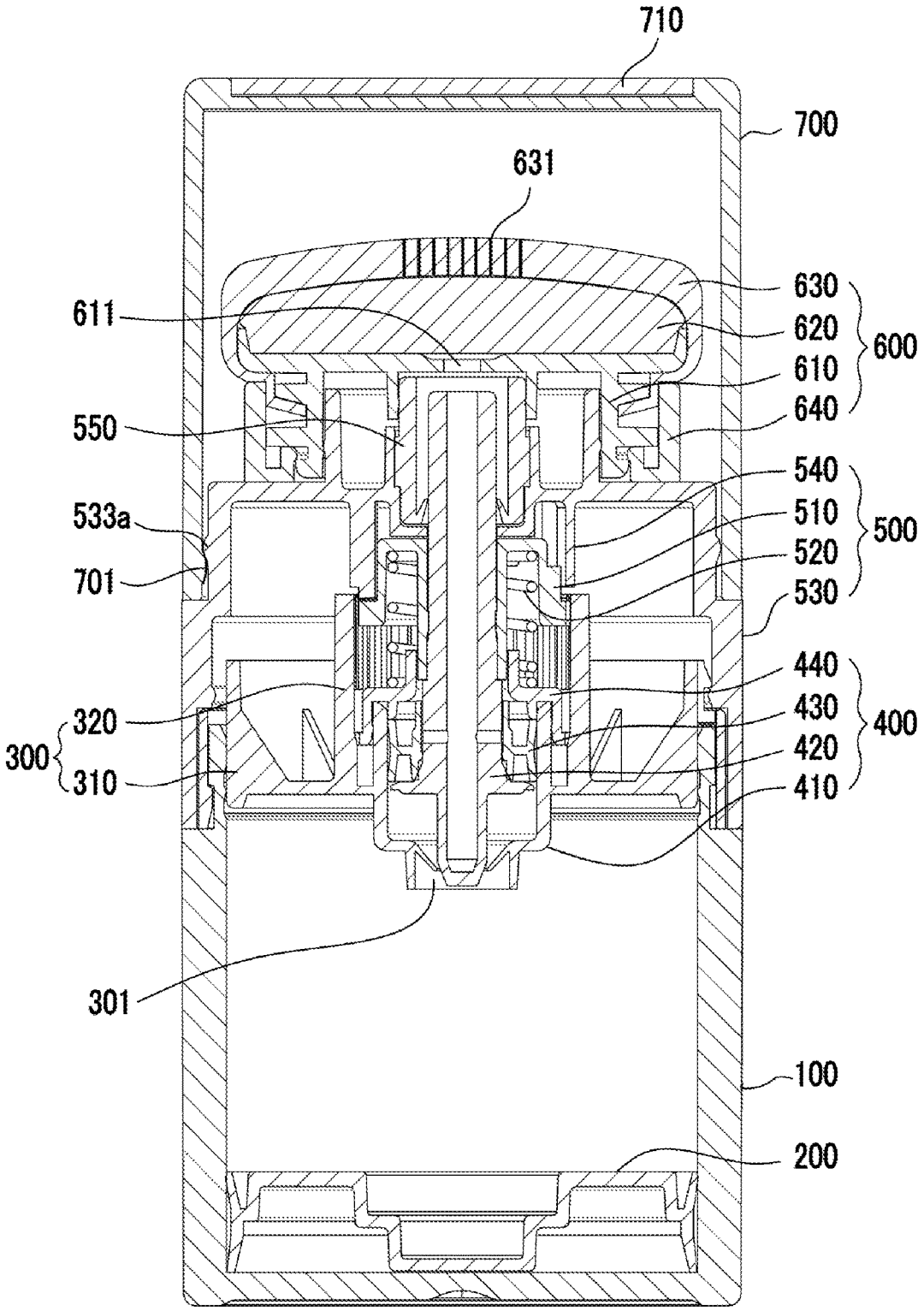
FIG. 3 is a longitudinal cross-sectional view of FIG. 1.

FIG. 1 is a perspective view of a liquid cosmetics case according to an embodiment of the present invention, FIG. 2 is an exploded perspective view of FIG. 1, and FIG. 3 is a longitudinal cross-sectional view of FIG. 1.

As illustrated in FIGS. 1 to 3, the liquid cosmetics case according to an embodiment of the present invention may include a case body 100, a pressing holder unit 200, a solder unit 300, a valve unit 400, a valve actuator unit 500, an applicator unit 600, and a case lid 700.

The case body 100 has a hollow circular tube shape having an opened upper portion and a closed lower portion. A liquid cosmetics content (see reference numeral 1 of FIGS. 19 and 20) is filled into the case body 100.

Also, a solder coupling part 101 extending from an upper end of the case body 100 and having inner and outer diameters less than those of the case body 100 so that an outer circumferential surface of the solder coupling part 101 is inserted into and coupled to an inner circumferential surface of the solder unit 300 may be provided on the case body 100.

The pressing holder unit 200 is slidably inserted into the case body 1000 to press and push the liquid content 1 toward a discharge side of the case body 100 so that the content 1 within the case body 100 is smoothly discharged. The liquid content 1 is filled between the pressing holder unit 200 and the solder unit 300 in the case body 100.

The pressing holder unit 200 may include a pressing part 210 inserted into the case body 100 to push the content 1 toward the discharge side of the case body 100 and a contact part 220 disposed on an edge of the pressing part 210 to slidably come into contact with the inner circumferential surface of the case body 100. The contact part 220 may have a shape of which a central portion is more recessed toward a center of the pressing part 210 than both ends of the pressing part 210. Thus, the central portion of the contact part 220 may not come into contact with the inner circumferential surface of the case body 100, and only both the ends of the contact part 220 may slidably come into contact with the inner circumferential surface of the case body 100.

The solder unit 300 may be coupled to the upper opened portion of the case body 100, and a discharge tube 320 having a discharge hole 301 may be provided in a central portion of the solder unit 300. The solder unit 300 may include a solder body 310 and the discharge tube 320.

The valve unit 400 is inserted and coupled to the discharge tube 320 at the outside of the case body 100 to open or close the discharge hole 301 so that the liquid content 1 within the case body 100 is discharged to the outside, or the discharge of the content 1 to the outside is blocked according to the elevation of the valve nozzle 420. The valve unit 400 may include a valve housing 410, a valve nozzle 420, a switching member 430, and a valve cap 440. Particularly, according to the present invention, since the valve housing 410 is integrally formed within the discharge tube 320 of the solder unit 300, the number of parts of the valve unit 400 may be reduced, and thus, manufacturing costs may be reduced.

The valve actuator unit 500 may be rotatably coupled to an upper portion of the solder unit 300. When the valve actuator unit 500 is rotated, the valve nozzle 420 of the valve unit 400 may be elevated to open and close the discharge hole 301. That is, the valve actuator unit 500 may convert rotation movement into vertical linear movement of the valve nozzle 420 to open and close the discharge hole 301, thereby discharging and blocking the content. For example, when the valve actuator unit 500 is rotated to allow the valve nozzle 420 to descend, the discharge hole 301 may be opened to discharge the content 1. On the other hand, when the valve actuator unit 500 is rotated to allow the valve nozzle 420 to ascend, the discharge hole 301 may be closed to block the discharge of the content 1. The valve actuator unit 500 may include a first cam part 510, an elastic member 520, and a rotatable cap 530.

The applicator unit 600 may be installed on an upper portion of the valve actuator unit 500. The content 1 discharged by the rotation of the valve actuator unit 500 may be discharged through a plurality of fine discharge holes 631. The applicator unit 600 may include an applicator holder 610, an absorption pad 620, and a cosmetic pad 630.

The case lid 700 has a circular tube shape with an opened lower portion. The case lid 700 is detachably coupled to the rotatable cap 530 of the valve actuator unit 500. Thus, when used, the case lid 700 may be separated from the rotatable cap 530 to allow the applicator unit 600 to be exposed to the outside. When is not used, the case lid 700 may be coupled to the rotatable cap 530 to cover the applicator unit 600 so that the applicator unit 600 is not exposed to the outside. A fixing protrusion 701 engaged with the a fixing protrusion 533*a* disposed outside a lid coupling part 533 of the rotatable cap 530 to prevent the case lid 700 from being separated may protrude inside the opened portion of the case lid 700.

Also, a mirror 710 may be attached to a top surface of the case lid 700 so that a user applies makeup while looking into the mirror 710.

Figure 4:
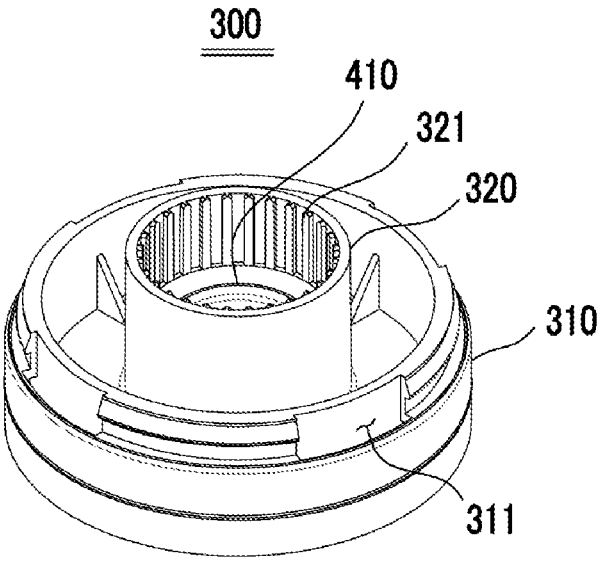
FIG. 4 is a perspective view of a solder unit of FIG. 2.
Figure 5:
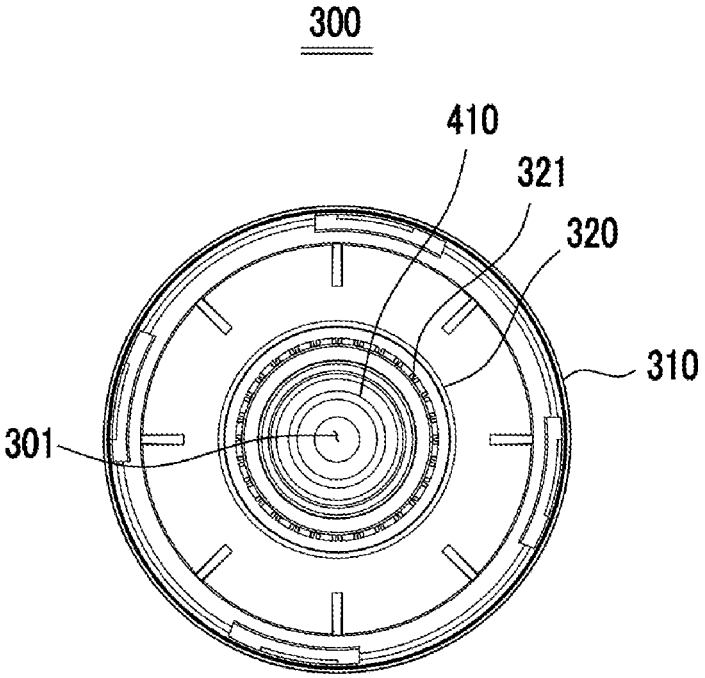
FIG. 5 is a plan view of the solder unit of FIG. 2.
Figure 6:
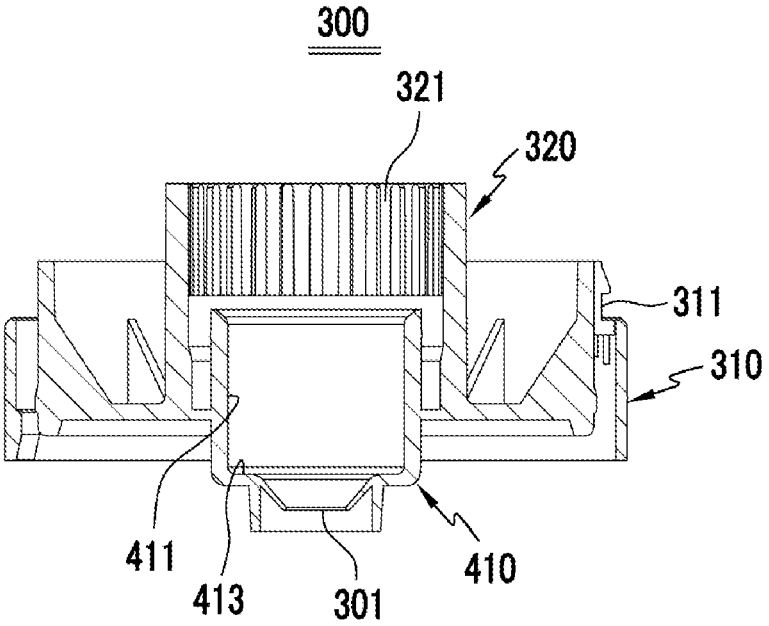
FIG. 6 is a longitudinal cross-sectional view of the solder unit of FIG. 2.

FIG. 4 is a perspective view of the solder unit of FIG. 2, FIG. 5 is a plan view of the solder unit of FIG. 2, and FIG. 6 is a longitudinal cross-sectional view of the solder unit of FIG. 2.

As illustrated in FIGS. 4 to 6, the solder unit 300 may be fitted into and coupled to the outside of an upper end of the case body 100. The solder unit 300 may include the solder body 310 and the discharge tube 320.

The solder body 310 may have a circular shape to cover the upper opened portion of the case body 100, and a lower inner circumferential surface of the solder body 310 may be fitted and coupled to an outer circumferential surface of the solder coupling part 101 disposed on the upper end of the case body 100. Also, a rotation coupling groove 311 to which a rotation coupling protrusion 531*a* disposed on an inner circumferential surface of a rotation coupling part 531, which will be described below, of the rotatable cap 530 is rotatably fitted is disposed on the outer circumferential surface of the solder body 310.

The discharge tube 320 has a hollow circular tube shape and extends perpendicular to a central portion of a top surface of the solder body 310. The discharge hole 301 is defined in a lower end of the discharge tube 320. A plurality of elevation guide grooves 321 are longitudinally provided in an inner circumferential surface of the discharge tube 320. Thus, since a rotation prevention protrusion 517 of the first cam part 510 is inserted into the elevation guide grooves 321, the first cam part 510 is not rotated by being interlocked with the rotation of a second cam part 520 integrally formed within the rotatable cap 530 and thus is elevatable.

Also, the discharge tube 320 may be integrated with the valve housing 410 therein, and a lower portion of the valve housing 410 may communicate with the discharge hole 301. That is, since the valve housing 410 of the valve unit 400 is integrally formed within the discharge tube 320 of the solder unit 300, the number of parts of the valve unit 400 may be reduced, and thus, manufacturing costs may be reduced.

The valve housing 410 may include a nozzle insertion part 411 and a stepped part 413.

The nozzle insertion part 411 has a hollow circular tube shape. The nozzle insertion part 411 has a diameter less than that of the discharge tube 320 so as to be inserted into the lower portion of the inside of the discharge tube 320. Also, the nozzle insertion part 411 has a height less than that of the discharge tube 320.

The stepped part 413 extends in a stepped shape inward from the other end of the nozzle insertion part 31, and a discharge hole 301 is defined in a central portion of the stepped part 413. An annular protrusion 423, which will be described below, of the valve nozzle 420 may be hooked on the stepped part 413 to prevent the nozzle body 421 from being further slid downward, thereby preventing the valve nozzle 420 from being separated from the nozzle insertion part 411.

When the valve nozzle 420 is slid downward within the nozzle insertion part 411, a gap may be generated between the stepped part 413 and the valve nozzle 420. Here, the content 1 filled into the case body 100 may be introduced into the nozzle insertion part 411 through the gap. On the other hand, when the valve nozzle 420 is slid upward, the gap between the stepped part 413 and the valve nozzle 420 may be closed to block the introduction of the content 1, which is filled into the case body 100, into the nozzle insertion part 411.

Figure 7:
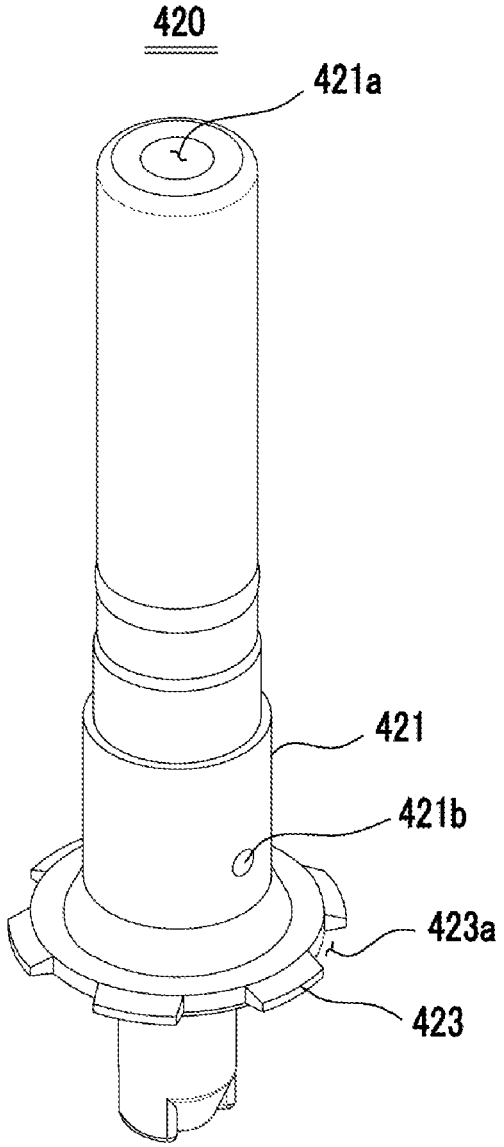
FIG. 7 is a perspective view of a valve nozzle of FIG. 2.
Figure 8:
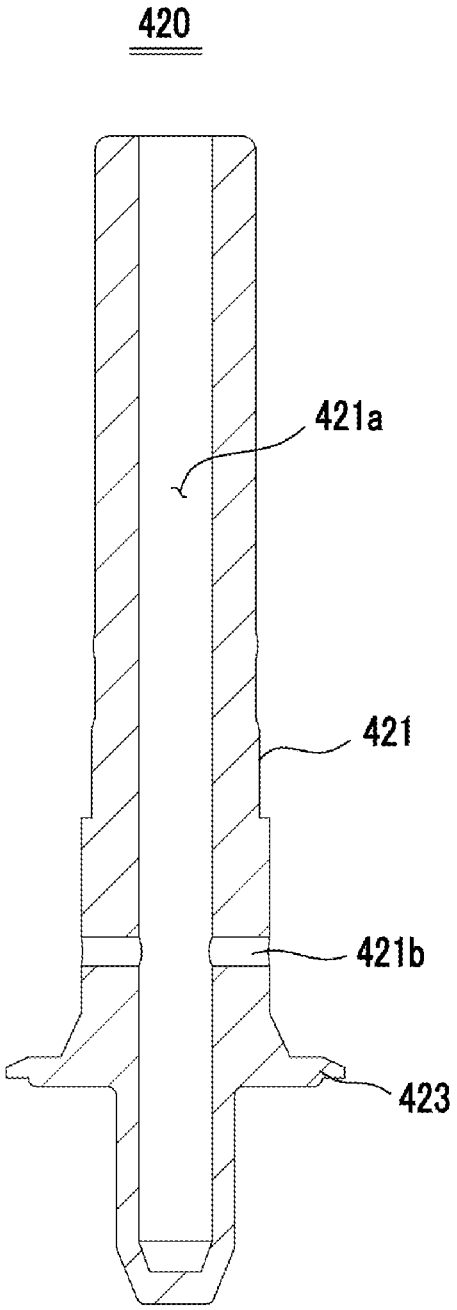
FIG. 8 is a longitudinal cross-sectional view of the valve nozzle of FIG. 2.

FIG. 7 is a perspective view of the valve nozzle of FIG. 2, and FIG. 8 is a longitudinal cross-sectional view of the valve nozzle of FIG. 2.

As illustrated in FIGS. 7 and 8, the valve nozzle 420 is installed to slidably pass through the nozzle insertion part 411 of the valve housing 410. The valve nozzle 420 may include the nozzle body 421 and the annular protrusion 423.

A nozzle hole 421*a* that is opened to an upper end of the nozzle body 421 is lengthily defined in the nozzle body 421, and an inflow hole 421*b* connected to the nozzle hole 421*a* is defined in a side portion of the nozzle body 421.

The annular protrusion 423 is disposed at a position of the side portion of the nozzle body 421, which is spaced apart from the inflow hole 421*b* toward the closed lower end of the nozzle body 421 and is hooked on the stepped part 413 disposed on the nozzle insertion part 411 of the valve housing 410 to prevent the nozzle body 421 from being further slid downward. Also, a plurality of fine holes 423*a* through which the liquid content 1 introduced between the lower end of the nozzle body 421 and the valve housing 410 passes are defined to be spaced apart from each other in the annular protrusion 423.

Figure 9:
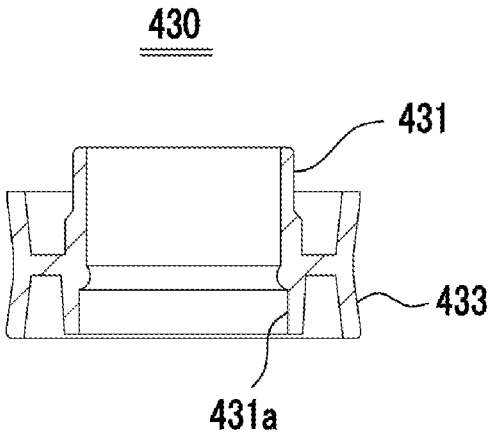
FIG. 9 is a longitudinal cross-sectional view of a switching member of FIG. 2.

FIG. 9 is a longitudinal cross-sectional view of the switching member of FIG. 2.

As illustrated in FIG. 9, the switching member 430 is movably fitted outside the nozzle body 421. Thus, when the nozzle body 421 moves to the discharge hole 301, i.e., when the nozzle body 421 descends in the drawing, the switching member 430 is pushed to a side opposite to the discharge hole 301 by a pressure of the content 1 introduced between the valve housing 410 and the nozzle body 421 to open the inflow hole 421*b*. When the nozzle body 421 moves to the side opposite to the discharge hole 301, i.e., when the nozzle body 421 ascends in the drawing, the switching member 430 is pushed by the nozzle body 421 to return to its original position, thereby closing the inflow hole 421*b*. Here, the switching member 430 may be movably fitted into a portion of the nozzle body 421, in which the inflow hole 421*b* is defined with respect to the annular protrusion 423.

The switching member 430 may include a hollow switching part 431 that is fitted outside the nozzle body 421 and a contact part 433 extending to the outside of the switching part 431 to slidably come into contact with the inside of the nozzle insertion part 411 of the valve housing 410.

A clearance groove 431*a* defining a clearance without coming into contact with the nozzle body 421 is defined in a portion of an inner circumferential surface of the switching part 431 at a side of the annular protrusion 423 of the valve nozzle 420. Thus, when the switching part 431 is slid to a side opposite to the annular protrusion 423 to allow the clearance groove 431*a* to overlap the inflow hole 421*b*, the content 1 introduced into the clearance groove 431*a* is introduced into the nozzle hole 421*a* through the inflow hole 421*b*. On the other hand, when the switching part 431 is slid toward the annular protrusion 423 to allow the clearance groove 431*a* to be dislocated with respect to the inflow hole 421*b*, the introduction of the content 1 through the inflow hole 421*b* is blocked by the inner circumferential surface of the switching part 431 coming into contact with the nozzle body 421.

The contact part 433 has a shape of which a central portion is relatively recessed in an inner direction of the switching part 431 when compared to both ends of the contact part 433. Thus, the central portion of the contact part 433 does not come into contact with an inner circumferential surface of the nozzle insertion part 411, and only both ends of the contact part 433 slidably come into contact with the inner circumferential surface of the nozzle insertion part 411.

Figure 10:
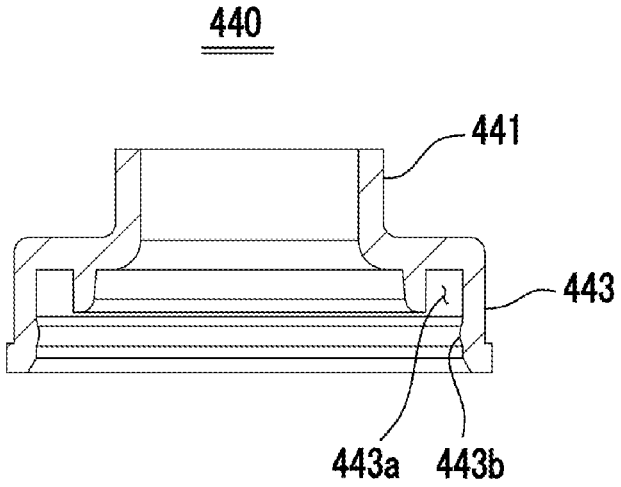
FIG. 10 is a longitudinal cross-sectional view of a valve cap of FIG. 2.

FIG. 10 is a longitudinal cross-sectional view of the valve cap of FIG. 2.

As illustrated in FIG. 10, the valve cap 440 is coupled to an upper end of the valve housing 410 to electrically support the first cam part 510 that will be described below by the elastic member 520, e.g., a spring (hereinafter, expressed by reference numeral 520). The valve cap 440 may include a valve cap body 441 having a hollow circular tube shape and fitted outside a lower end of the first cam part 510 and a cap coupling part 443 extending to be bent downward from the outside of the valve cap body 441 and having a fit-coupling groove 443*a* into which an upper end of the nozzle insertion part 411 of the valve housing 410 is fitted and coupled between the lower end of the valve cap body 441 and the cap coupling part 443. A hook protrusion 443*b* that is hooked on an outer surface of the nozzle insertion part 411 to allow the valve cap 441 to be engaged with and coupled to the valve housing 410 may protrude from an inner surface of the cap coupling part 443.

Figure 11:
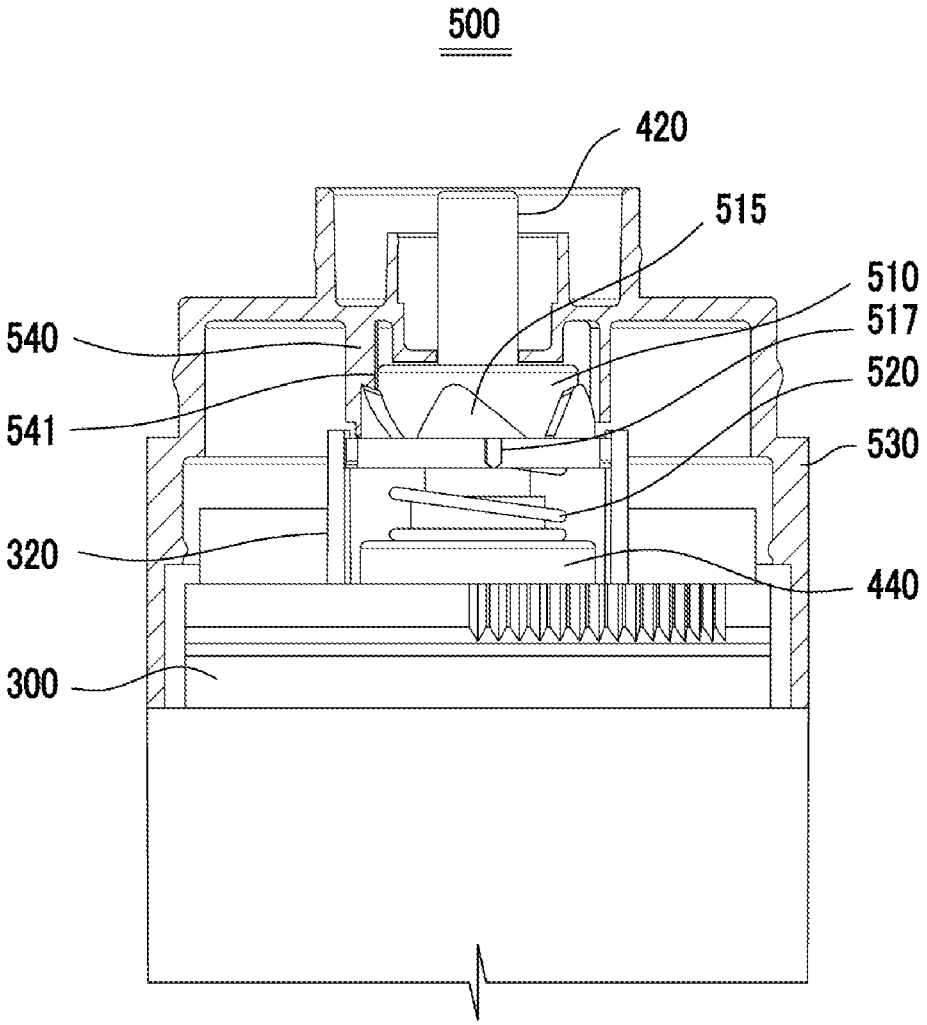
FIG. 11 is a view illustrating a configuration of a valve actuator unit of FIG. 2.

FIG. 11 is a view illustrating a configuration of the valve actuator unit of FIG. 2.

As illustrated in FIG. 11, the valve actuator unit 500 may include the first cam part 510 fitted to be coupled to the valve nozzle 420 and elevated, the elastic member 520 elastically supporting the first cam part 510 with respect to the valve cap 440, and the rotatable cap 530 integrally formed within the second cam part 540 that is rotatably coupled to the outside of the solder unit 300 to elevate the first cam part 510. Here, the elastic member 520 may include a spring. The spring 520 has an upper end coming into contact with and supported by the first cam part 510 and a lower end coming into contact with and supported by the valve cap 440.

Figure 12:
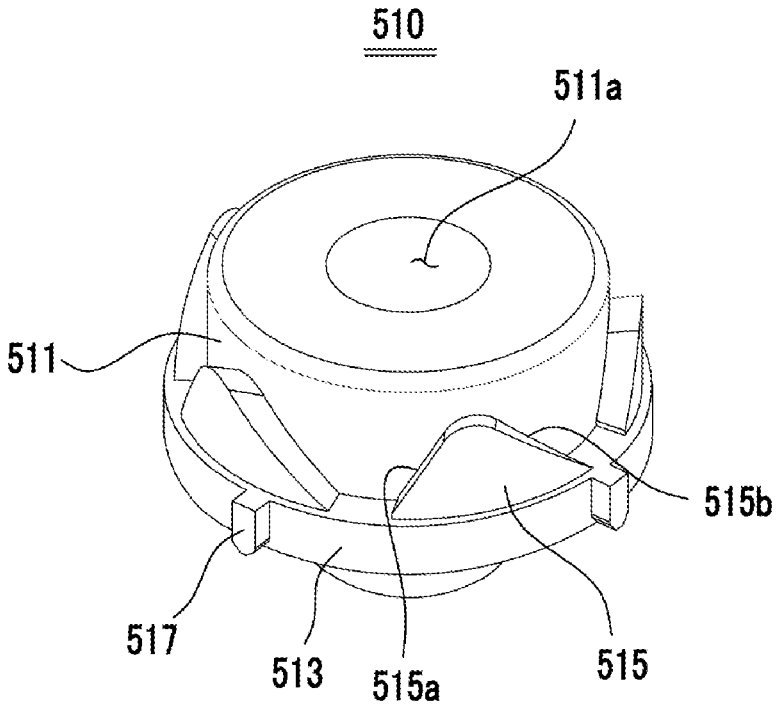
FIG. 12 is a perspective view of a first cam part of FIG. 2.
Figure 13:
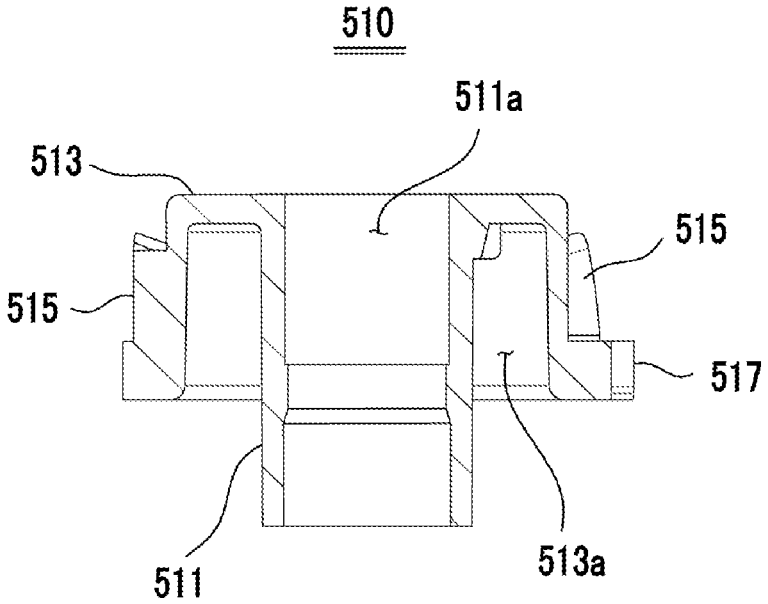
FIG. 13 is a longitudinal cross-sectional view of the first cam part of FIG. 2.

FIG. 12 is a perspective view of the first cam part of FIG. 2, and FIG. 13 is a longitudinal cross-sectional view of the first cam part FIG. 2.

As illustrated in FIGS. 12 to 13, the first cam part 510 is fitted into and coupled to an upper portion of the valve cap 440, and the valve nozzle 420 passes through a through hole 511*a* defined in a central portion of the first cap part 510 and then is coupled to the first cam part 510. Also, the first cam part 510 vertically moves within the discharge tube 320 by being interlocked with the rotation of the second cam part 540 to vertically move the valve nozzle 420 fitted into the first cam part 510.

The first cam part 510 may include a first cam body 511, an elastic member support 513, a first inclined sawtooth 515, and a rotation prevention protrusion 517.

The first cam body 511 has a hollow circular tube shape with the through hole 511*a* to allow the nozzle body 421 to pass through a center of the inside of the first cam body 511. A spring 520 is fitted outside the lower end of the first cam body 511 to elastically support the first cam body 511 upward with respect to the valve cap 440.

The elastic member support 513 extends to the outside of the first cam body 511 to support the spring 520 fitted outside the lower end of the first cam body 511. A spring fitting groove 513*a* is defined between the elastic member support 513 and the first cam body 511.

The inclined sawtooth 515 may be provided in plurality on an outer surface of the first cam body 511 at a predetermined interval in a circumferential direction. The inclined sawtooth 515 may have a triangular shape with an upward inclined surface 515*a* and a downward inclined surface 515*b* with respect to the rotation direction of the rotatable cap 530. Thus, when the rotatable cap 530 is rotated, a cam protrusion 541 of the second cam part 540, which will be described later, may come into contact with the upward inclined surface 515*a* to move the first cam part 510 downward. As a result, the valve nozzle 420 moves to the discharge hole 301 to open the discharge hole 301, and the cam protrusion 541 of the second cam part 540 passes through the upward inclined surface 515*a* to come into contact with the downward inclined surface 515*b* and thereby to move the first cam part 510 upward. As a result, the valve nozzle 420 may move to an opposite side of the discharge hole 301 to close the discharge hole 301.

Although the inclined sawtooth 515 has the triangular shape with the upward inclined surface 515*a* and the downward inclined surface 515*b* in the current embodiment, the embodiment is not limited thereto. For example, the inclined sawtooth 515 may have a right-angled triangular shape in which an inclined surface and a vertical surface are perpendicular to each other.

At least one rotation prevention protrusion 517 may be disposed on an outer circumferential surface of the first cam body 511, preferably, a plurality of rotation prevention protrusions 517 may be disposed along the outer circumferential surface of the first cam body 511 at a predetermined interval and then inserted into an elevation guide groove 321 of the solder unit 300. Thus, when the rotatable cap 530 is rotated, since the rotation prevention protrusion 517 move along the elevation guide groove 321, the rotation prevention protrusion 517 may be elevated within the discharge tube 320 if the first cam part 510 is not rotated.

Figure 14:
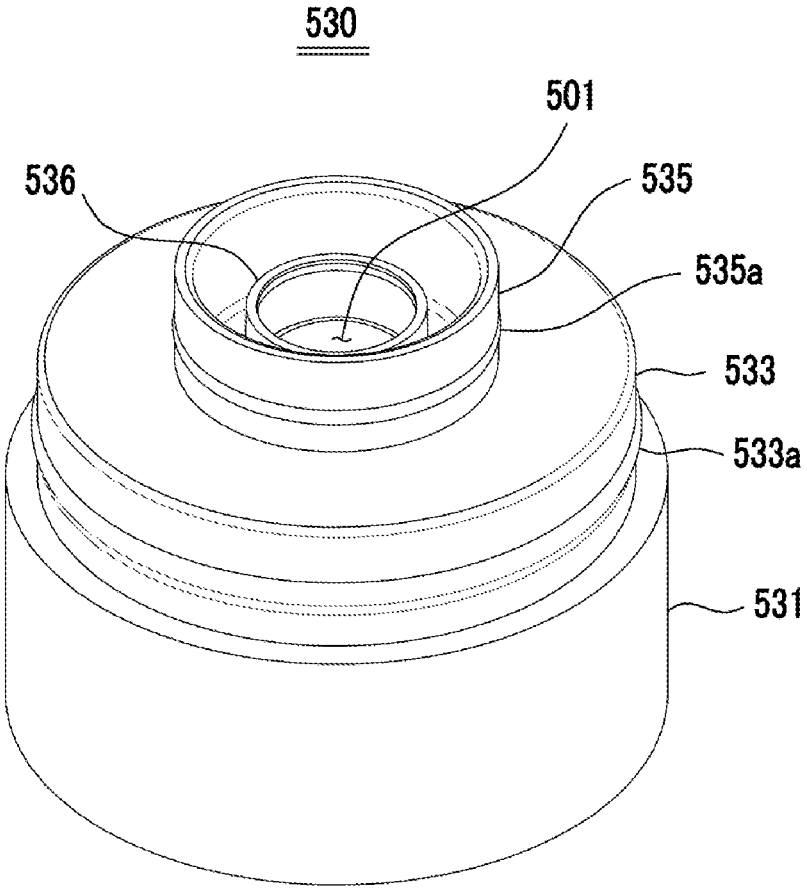
FIG. 14 is a perspective view of a rotatable cap of FIG. 2.
Figure 15:
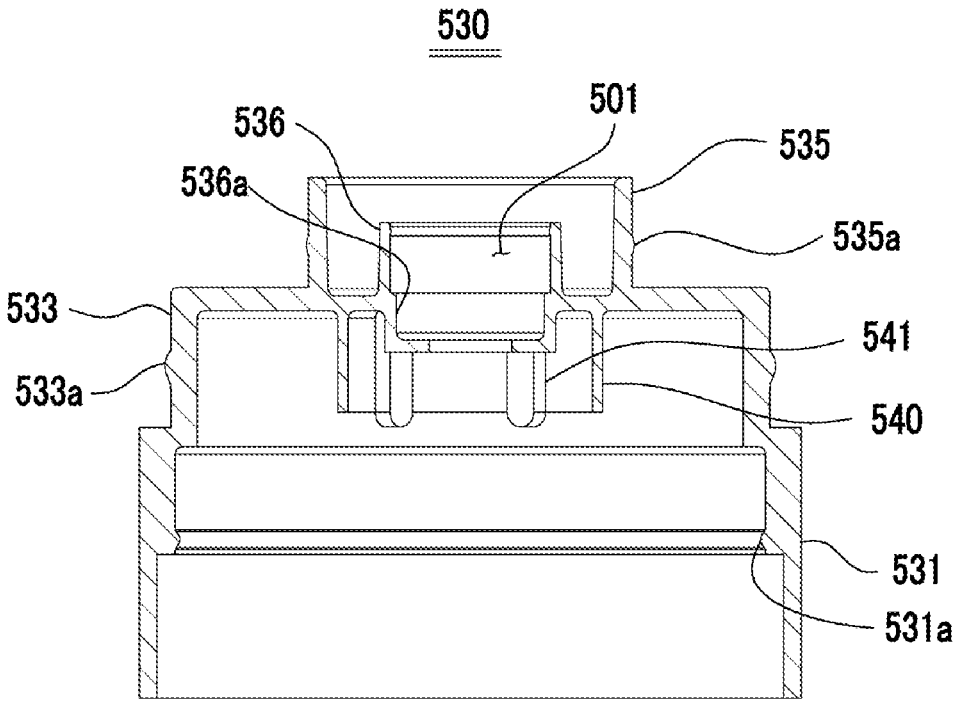
FIG. 15 is a longitudinal cross-sectional view of the rotatable cap of FIG. 2.

FIG. 14 is a perspective view of the rotatable cap of FIG. 2, and FIG. 15 is a longitudinal cross-sectional view of the rotatable cap of FIG. 2.

As illustrated in FIGS. 14 and 15, the rotatable cap 530 is fitted and rotatably coupled to the outside of the solder unit 300. The rotatable cap 530 may include a rotation coupling part 533, a lid coupling part 535, an applicator holder coupling part 535, and the second cam part 540.

The rotation coupling part 531 has a hollow circular tube shape, and an inner surface of the rotation coupling part 531 is fitted and rotatably coupled to an outer surface of the solder unit 300. Also, a rotation coupling protrusion 531 is disposed on an inner surface of the rotation coupling part 531 so that the rotation coupling protrusion 531*a* is fitted and rotatably coupled to a rotation coupling groove 311 defined in the outer circumferential surface of the solder unit 300.

The lid coupling part 533 extends from an upper end of the rotation coupling part 531 and has inner and outer diameters less than those of the rotation coupling part 531. Also, the case lid 700 is detachably fitted outside the lid coupling part 533. A fixing protrusion 533*a* to which the case lid 700 is hooked and fixed protrudes from an outer surface of the lid coupling part 533.

The applicator holder coupling part 535 protrudes to extend from a top surface of the lid coupling part 533 and has a circular tube shape of which inner and outer diameters are less than those of the lid coupling part 533. Also, the applicator holder 610 is detachably fitted outside the applicator holder coupling part 535. A hook projection 535 is disposed on a lower end of an outer circumferential surface of the applicator holder coupling part 535. Thus, a hook protrusion 610*a*, which will be described later, disposed on a lower end of an inner circumferential surface of the applicator holder 610 is hooked and fixed to the hook projection 535*a*. Also, a hollow sealing insertion part 536 is defined in a center of the top surface of the applicator holder coupling part 535, and also, the discharge hole 501 through which an upper end of the nozzle body 421 passes is defined in the center of the top surface of the applicator coupling part 535.

The second cam part 540 is integrally provided in a hollow circular tube shape on an inner lower portion of a central portion of the top surface of the applicator holder coupling part 535 and also has the discharge hole 501 through which an upper end of the nozzle body 421 passes through a center of a top surface of the second cam part 540. Also, the second cam part 540 includes a plurality of cam protrusions 541 on an inner surface thereof at a predetermined interval in a circumferential direction thereof to correspond to the inclined sawtooth 515 of the first cam part 510. The cam protrusion 541 may have the form of a linear type cam protrusion 541 protruding inward in a longitudinal direction of the second cam part 540.

Since the inclined sawtooth 515 is disposed on the first cam part 510, and the cam protrusion 541 is disposed on the second cam part 540 that is integrated with the rotatable cap 530, when the rotatable cam 530 is rotated, the cam protrusion 541 of the second cam part 540 is rotated to move the first cam part 510 by the inclined contact with the inclined sawtooth 515 of the first cam part 510 and thereby to elevate the nozzle body 421 connected to the first cam part 510, thereby opening and closing the discharge hole 310.

As described above, since the second cam part 540 is integrally formed within the rotatable cam 530, it is unnecessary to manufacture the second cam part 540 as a separate part, and thus, the number of parts may be reduced to reduce the manufacturing costs.

Figure 16:
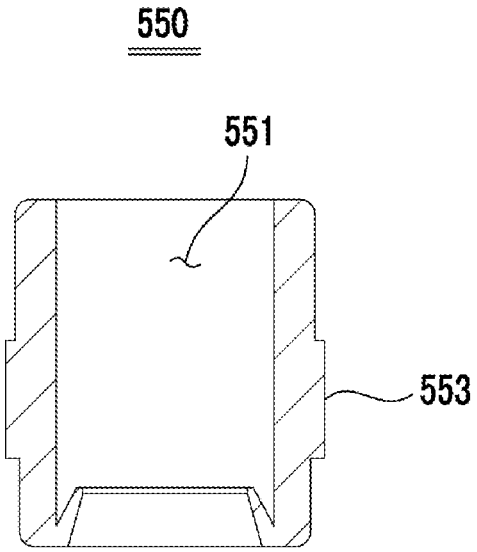
FIG. 16 is a longitudinal cross-sectional view of a sealing member of FIG. 2.

FIG. 16 is a longitudinal cross-sectional view of the sealing member of FIG. 2.

As illustrated in FIG. 16, the sealing member 550 is inserted into and coupled to the discharge hole 501 of the applicator holder coupling part 535 and has a through hole 551 in a central portion thereof. An upper end of the nozzle body 421 is inserted to pass through the through hole 551 of the sealing member 550, thereby preventing the liquid from leaking between the nozzle body 421 and the discharge hole 501 by the sealing member 550.

The sealing member 550 may have a hollow circular tube shape, and a hook protrusion 553 may be disposed on an outer circumferential surface of the sealing member 550 so that the hook protrusion 553 is hooked and fixed to the hook projection 536*a* disposed on an inner circumferential surface of the discharge hole 501 of the sealing insertion part 536.

Figure 17:
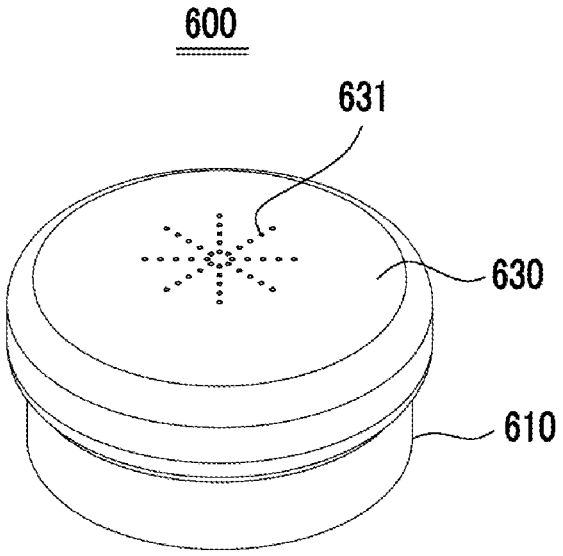
FIG. 17 is a perspective of an applicator unit of FIG. 2.
Figure 18:
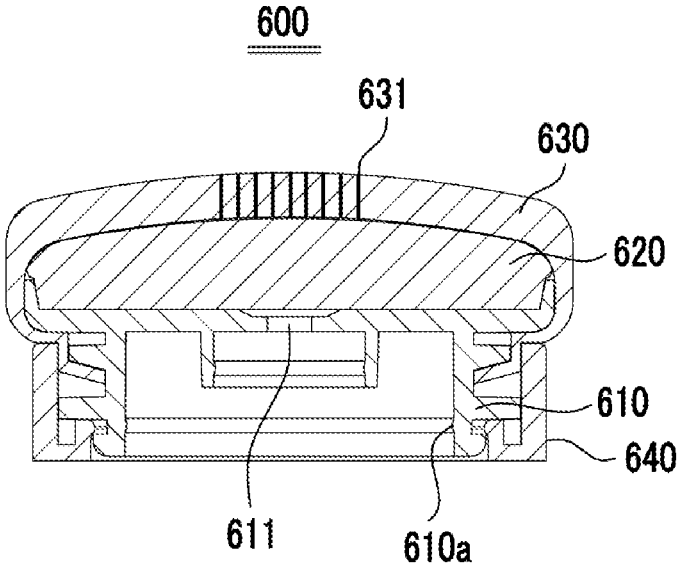
FIG. 18 is a longitudinal cross-sectional view of the applicator unit of FIG. 2.

FIG. 17 is a perspective view of the applicator unit of FIG. 2, and FIG. 18 is a longitudinal cross-sectional view of the applicator unit of FIG. 2.

As illustrated in FIGS. 17 and 18, the applicator unit 600 may include an applicator holder 610, an absorption pad 620, and a cosmetic pad 630.

The applicator holder 610 has a circular tube shape and is fitted and coupled to the outside of the applicator holder coupling part 535. Also, the applicator holder 610 has a discharge hole 611 in a central portion of a top surface thereof so that the discharge hole 611 is connected to the nozzle hole 421*a* of the nozzle body 421 through the through hole 551 of the sealing member 550.

The absorption pad 620 has a circular shape of which a central portion of a top surface is bent and is seated on the top surface of the applicator holder 610. The absorption pad 620 may absorb the content 1 discharged through the discharge hole 611 of the applicator holder 610 to keep the content just as much as used when the makeup is performed. The absorption pad 620 may be made of a sponge material having superior absorption to absorb the liquid content 1.

The cosmetic pad 630 is fixed to the applicator holder 610 in a state of covering a top surface of the absorption pad 620. Here, an outer lower end of the cosmetic pad 630 may be fixed by a pad fixing holder 640 fitted outside the applicator holder 610.

Also, the cosmetic pad 630 has a plurality of fine discharge holes 631 so that the content 1 absorbed to the absorption pad 620 is finely discharged. The fine discharge holes 631 may be formed in the cosmetic pad through laser processing. Although the fine discharge holes 631 are defined in a radial shape in the current embodiment, the embodiment of the present invention is not limited thereto. For example, the fine discharge holes 631 may be defined in various shapes such as a concentric shape.

The cosmetic pad 630 may prevent the content 1 from being transmitted and volatilized therethrough to prevent the content 1 absorbed to the absorption pad 620 from being lost. It is preferable that the cosmetic pad 630 is made of a ruby cell material having a superior application property when the makeup is performed. Thus, since the content 1 is discharged through the fine discharge holes 631 of the cosmetic pad 630, the user may easily apply the cosmetics without having the user's hand stained with the cosmetics.

Figure 19:
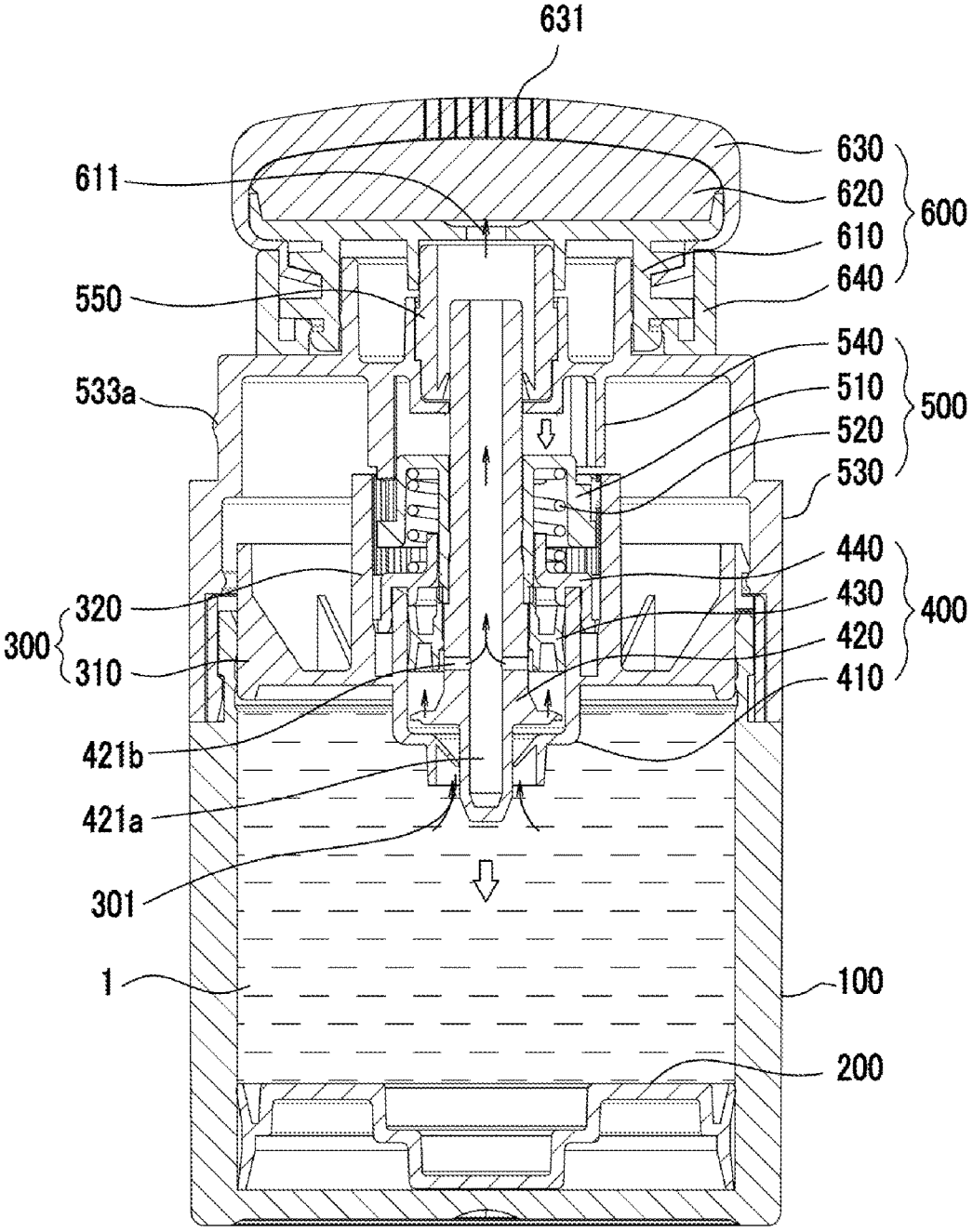
FIG. 19 is a view illustrating an operation state in which a content within the liquid cosmetics case is discharged according to an embodiment of the present invention.

FIG. 19 is a view illustrating an operation state in which the content within the liquid cosmetics case is discharged according to an embodiment of the present invention.

As illustrated in FIG. 19, when the user rotates the rotatable cap 530, the second cam part 540 integrally formed within the rotatable cap 530 is integrally rotated together with the rotatable cap 530. Thus, the cam protrusion 541 disposed on the inner surface of the second cam part 540 is rotated by being interlocked with the rotation of the second cam part 540 to come into contact with the upward inclined surface 515*a* of the inclined protrusions 515 disposed on the outer surface of the first cam part 510 in the rotation direction of the rotatable cap 530 and move the first cam part 510 downward. Here, since the rotation prevention protrusion 517 disposed on the outer surface of the first cam part 510 moves along the elevation guide groove 321 defined in the inner surface of the discharge tube 320, the first cam part 510 descends within the discharge tube 320 without being rotated.

In this process, the nozzle body 421 of the valve nozzle 420 fitted and coupled to the first cam part 510 moves downward, i.e., moves toward the discharge hole 301 by being interlocked with the descending of the first cam part 510. Here, the switching member 430 fitted and movably coupled to the outside of the nozzle body 421 is slid to a side opposite to the discharge hole 301 by a pressure of the content 1 introduced between the valve housing 410 and the nozzle body 421.

When the switching member 430 is slid to the side opposite to the discharge hole 301 to allow the clearance groove 431*a* defined in the inside of the switching part 431 to correspond to the inflow hole 421*b* defined in the nozzle body 421, the liquid content 1 is introduced into the nozzle hole 421*a* through the clearance groove 431*a* and the inflow hole 421*b*. The content 1 introduced into the nozzle hole 421*a* is absorbed to the absorption pad 620 through the discharge hole 611 defined in the applicator holder 610 and then discharged through the plurality of fine discharge holes 631 of the cosmetic pad 630.

Figure 20:
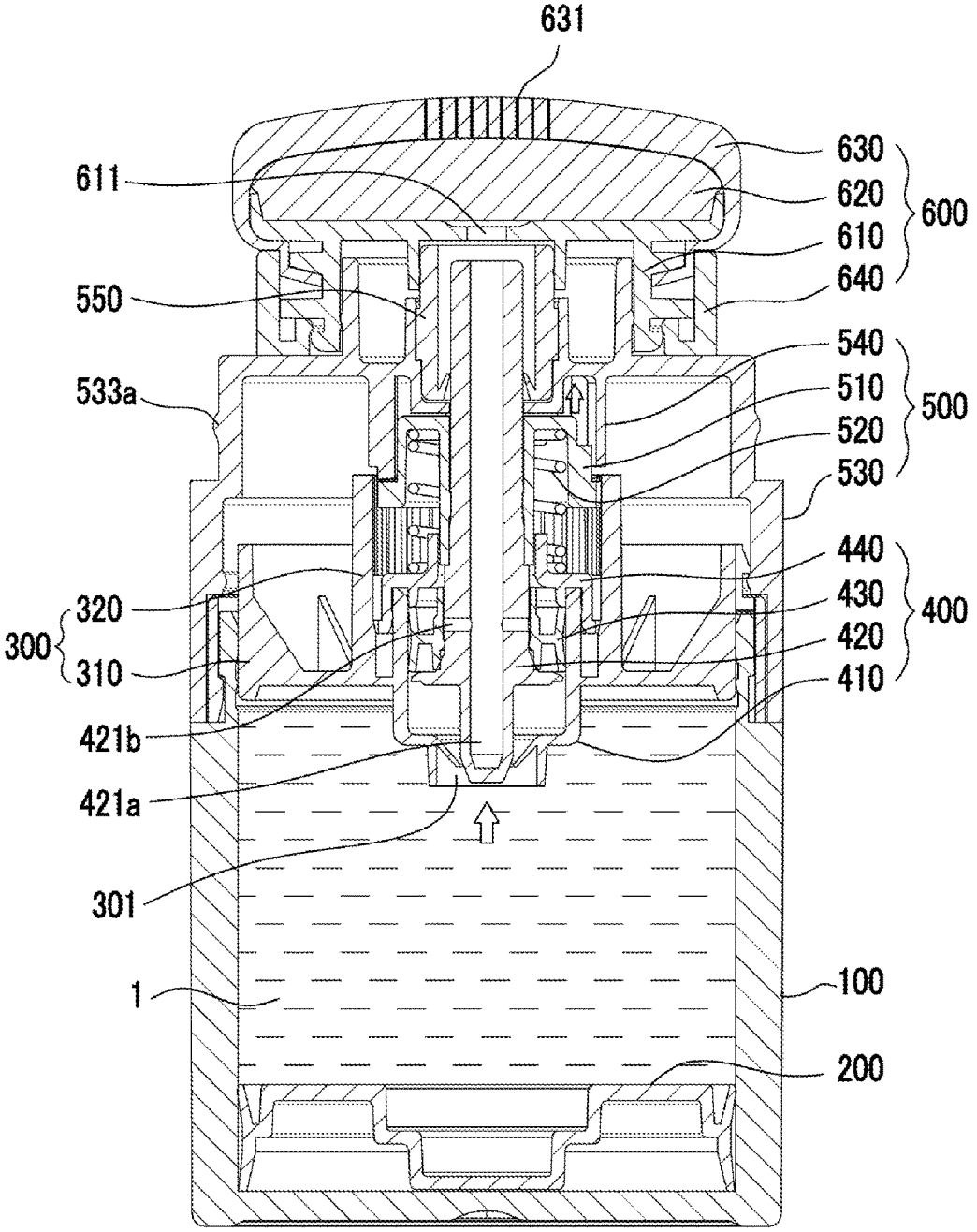
FIG. 20 is a view illustrating an operation state in which the discharge of the content within the liquid cosmetics case is blocked according to an embodiment of the present invention.

FIG. 20 is a view illustrating an operation state in which the discharge of the content within the liquid cosmetics case is blocked according to an embodiment of the present invention.

As illustrated in FIG. 20, when the first cam part 510 descends to open the valve unit 400, and then, the rotatable cap 530 is further rotated in a state in which the content 1 is discharged, the cam protrusion 541 of the second cam part 540 passes through the upward inclined surface 515*a* to come into contact with the downward inclined surface 515*b*, and then, the first cam part 510 returns to its original state by restoring force of the spring 520 to move upward.

In this process, the nozzle body 421 of the valve nozzle 420 fitted and coupled to the first cam part 510 moves downward, i.e., moves toward the discharge hole 301 by being interlocked with the descending of the first cam part 510. When the nozzle body 421 moves to the side opposite to the discharge hole 301, i.e., when the nozzle body 421 ascends, the switching member 430 is pushed by the nozzle body 421 to return to its original state, thereby closing the inflow hole 421*b*. Thus, the discharge of the content 1 is stopped.

According to the liquid cosmetics case according to an embodiment of the present invention, when the user rotates the rotating cap 530, the valve nozzle 420 of the valve unit 400 is elevated to open and close the discharge hole 301. Thus, the discharge and blocking of the liquid content 1 may be simply adjusted to improve the convenient in use.

Also, since the valve type in which the discharge hole 301 is opened and closed due to the elevation of the valve nozzle 410 is applied, the discharging portion may be always sealed on ordinary days. As a result, the valve type liquid cosmetic case may have superior airtightness. In addition, the valve type liquid cosmetic case may be applied to all liquid contents regardless to viscosity and have a relatively simple structure when compared to the existing button type or rotating type liquid cosmetic case. Thus, the manufacturing costs may be reduced, and the breakdown and malfunction may be minimized.

Also, since the second cam part 540 for elevating the first cam part 510, to which the valve nozzle 420 is coupled, is integrally formed within the rotatable cap 530, it may be unnecessary to manufacture the second cam part 540 as a separate part, thereby reducing the number of parts. Also, since the valve housing 410 constituting the valve unit 400 is integrally formed within the discharge tube 320 of the solder unit 300, the number of parts of the valve unit 400 may be reduced. Thus, the number of parts may be reduced to realize the simple structure, resulting in reducing the manufacturing costs.

Also, the applicator unit 600 may be configured so that the content 1 is finely discharged through the fine discharge hole 631 of the cosmetic pad 630 made of the ruby cell material in the state in which the absorption pad 620 made of the sponge material absorbs the content 1 to keep a predetermined amount of content to be used for the makeup. Thus, the user may easily apply the cosmetics and use the cosmetics without having the user's hand stained with the cosmetics.

Figure 21:
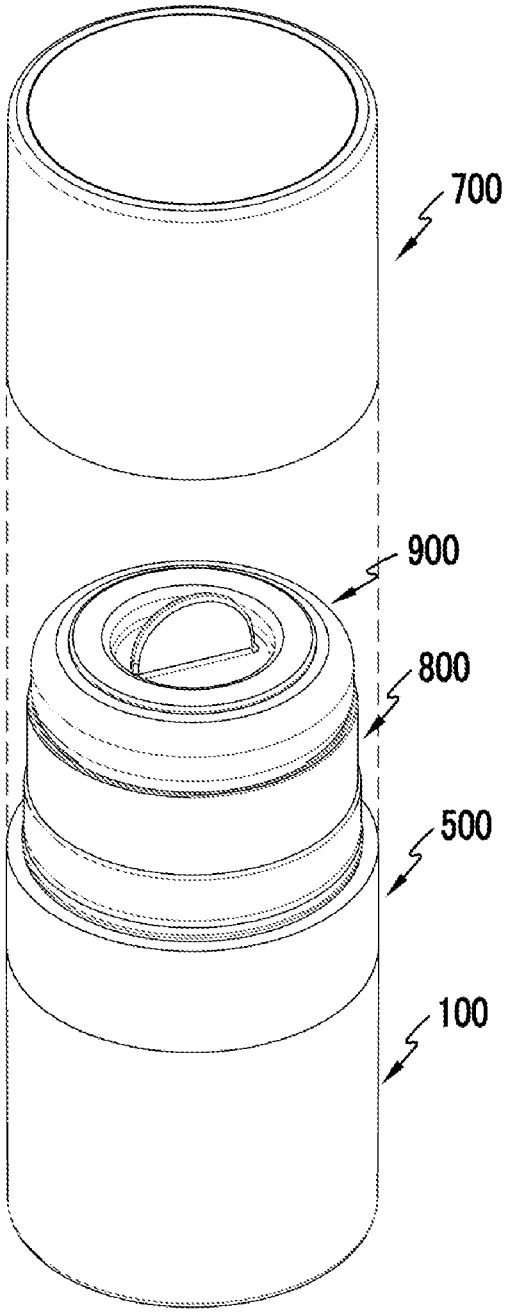
FIG. 21 is a perspective view of a liquid cosmetics case according to another embodiment of the present invention.
Figure 22:
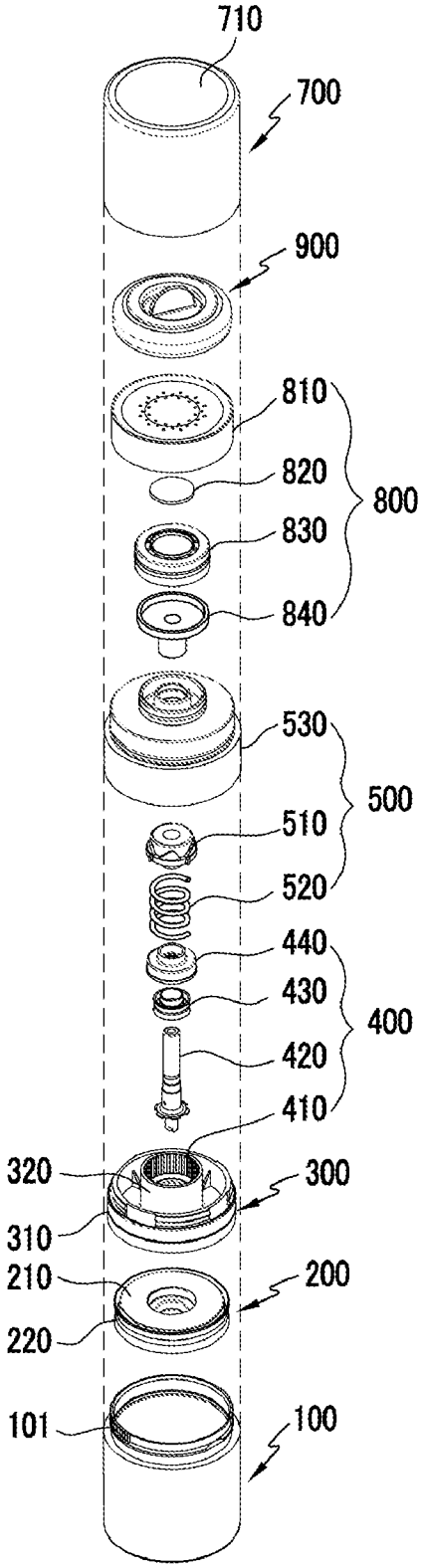
FIG. 22 is an exploded perspective view of FIG. 21.
Figure 23:
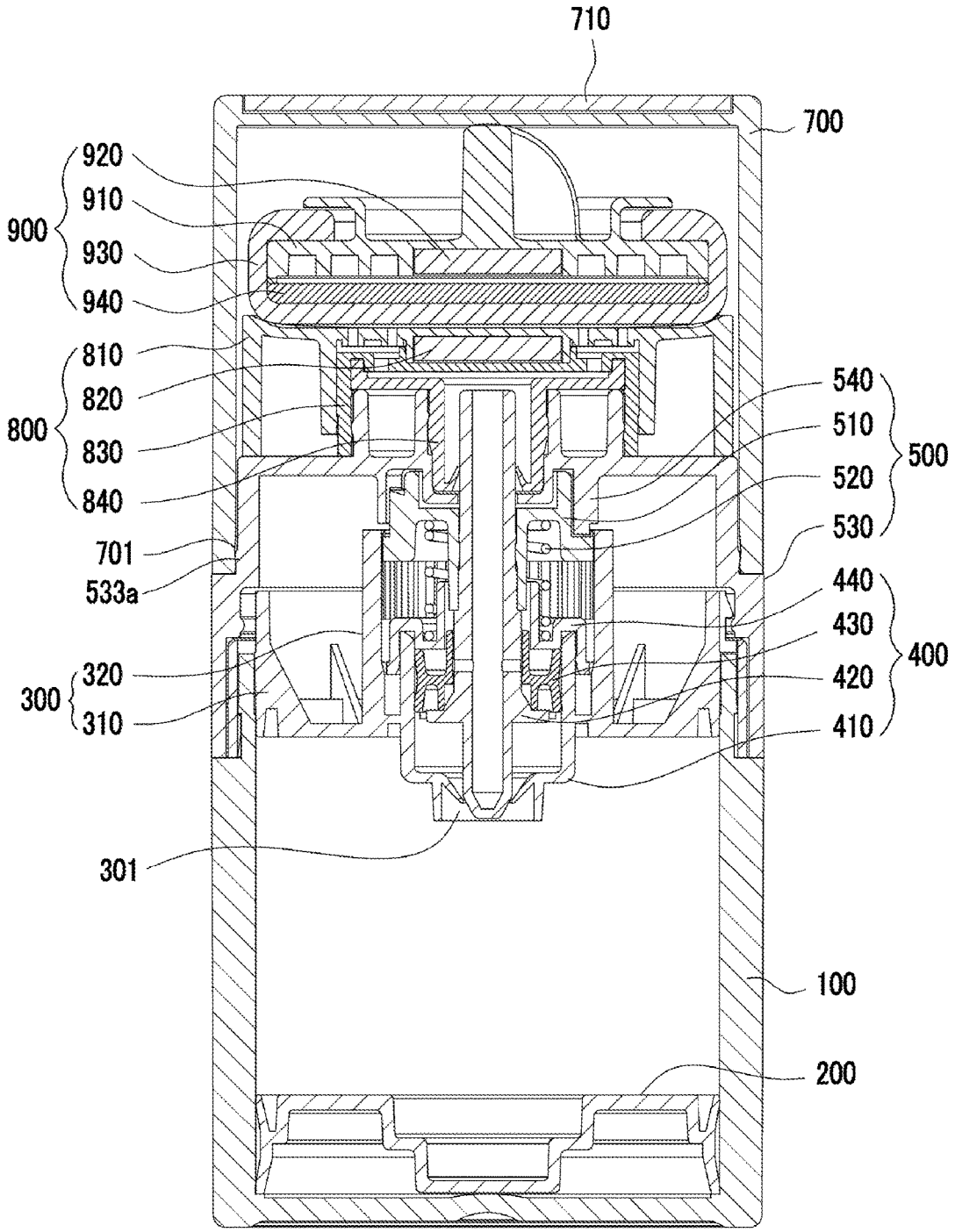
FIG. 23 is a longitudinal cross-sectional view of FIG. 21.

FIG. 21 is a perspective view of a liquid cosmetics case according to another embodiment of the present invention, FIG. 22 is an exploded perspective view of FIG. 21, and FIG. 23 is a longitudinal cross-sectional view of FIG. 21.

As illustrated in FIGS. 2 to 23, a liquid cosmetics case according to another embodiment of the present invention may include a case body 100, a pressing holder unit 200, a solder unit 300, a valve unit 400, a valve actuator unit 500, a case lid 700, an applicator unit 800, and a cosmetic puff 900. The liquid cosmetic case according to another embodiment of the present invention may be the same as that according to an embodiment of the present invention, which is described with reference to FIGS. 1 to 20, except for the applicator unit 800 and the cosmetic puff unit 900.

Thus, according to another embodiment of the present invention, the same components, which perform the same function as that of each of the components according to an embodiment, i.e., the case body 100, the pressing holder unit 200, the solder unit 300, the valve unit 400, the valve actuator unit 500, and the case lid 700 will be expressed by the same reference numeral as that according to an embodiment. Hereinafter, only the applicator unit 800 and the cosmetic puff 900, which are different from those according to an embodiment will be described in detail.

The applicator unit 800 may be installed on an upper portion of a valve actuator unit 500. A content 1 discharged by rotation of the valve actuator unit 500 may be discharged through a plurality of fine discharge holes 812. The applicator unit 800 may include an applicator holder 810, a first magnetic body 820 or metal member (not shown), a magnet cover 830, and a sealing member 840.

The cosmetic puff unit 900 is detachably installed on an upper portion of the applicator unit 800 by a magnetic property. When the cosmetic puff unit 900 is attached by the magnetic property, the cosmetic puff unit 900 may be maintained to seal the fine discharge holes 812 of the applicator unit 800. The cosmetic puff unit 900 may includes a handle holder 910, a second magnetic body 920, a cosmetic pad 930, and a sponge pad 940.

To attach the cosmetic puff unit 900 to the applicator unit 800 by using the magnetic property, the first magnetic body 820 or the metal member is built in the applicator unit 800, and the second magnetic body 920 having a polarity opposite to that of the first magnetic body 820 is built in the cosmetic puff unit 900. For example, the first magnetic body 820 may include an N-pole magnet, or the second magnetic body 920 may include an S-pole magnet. On the other hand, the first magnetic body 820 may include an S-pole magnet, or the second magnetic body 920 may include an N-pole magnet. The cosmetic puff unit 900 may be attached to the applicator unit 800 by attractive force between the first magnetic body 820 and the second magnetic body 920 or between the metal member and the second magnetic body 920.

The first magnetic body 820 and the metal member are inserted into a first magnet insertion groove 814 of the applicator unit 800, and the second magnetic body 920 is inserted into a second magnet insertion groove 913 of the cosmetic puff unit 900.

Figure 24:
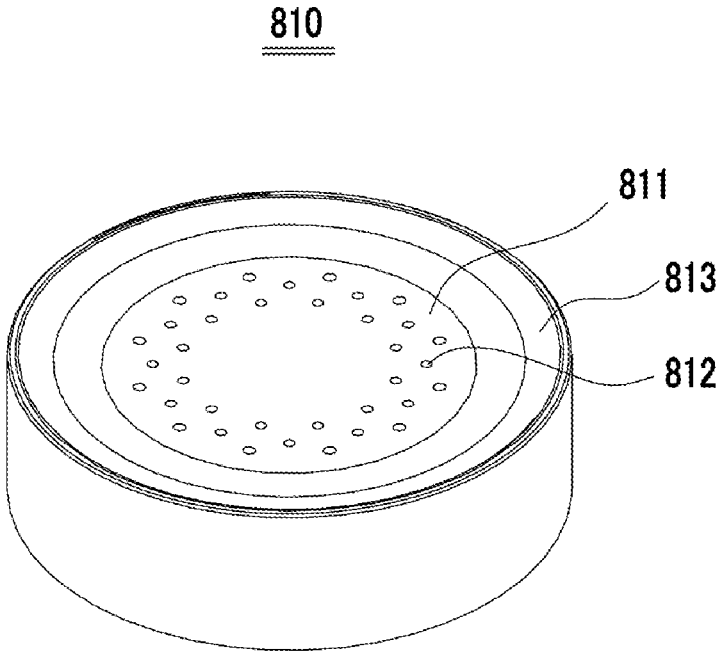
FIG. 24 is a perspective view of an applicator holder of FIG. 21.
Figure 25:
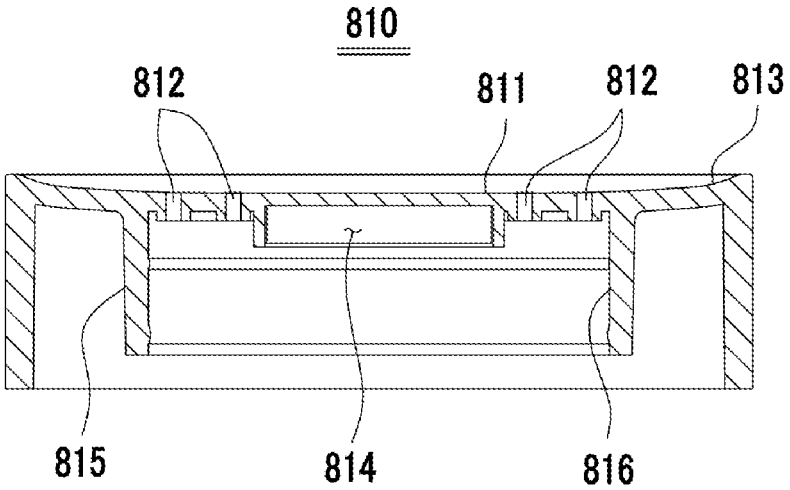
FIG. 25 is a longitudinal cross-sectional view of the applicator holder of FIG. 21.

FIG. 24 is a perspective view of the applicator holder of FIG. 21, and FIG. 25 is a longitudinal cross-sectional view of the applicator holder of FIG. 21.

As illustrated in FIGS. 24 and 25, the applicator holder 810 has a circular tube shape with a top surface 811 and an opened bottom surface and is installed above a rotatable cap 530.

In the applicator holder 810, a cylindrical magnet housing 815 having a first magnetic insertion groove 814 in a center of a lower portion of a top surface 811 thereof extends to stand upright downward from the top surface 811. A circular first magnetic body 820 or metal member is inserted into the first magnet insertion groove 814. A fixing groove 816 is defined in an inner circumferential surface of the magnet housing 815, and a fixing protrusion 835 disposed on an outer circumferential surface of the magnet cover 830 that will be described later is inserted into the fixing groove 816.

Also, a plurality of fine discharge holes 812 passing through a top surface of the magnet housing 815 are defined outside a center of the applicator holder 810, in which the first magnet insertion groove 814 is defined, to discharge the content 1 discharged by the rotation of the valve actuator unit 500 through the fine discharge holes 812.

Also, an edge border 813 of the top surface 811 of the applicator holder 810 may be roundly curved to correspond to a curve of an edge of a bottom surface of the cosmetic pad 930, which will be described later. For example, a central portion of the top surface of the applicator holder 810 may have a plane, and the edge border 813 of the top surface may be slightly roundly curved upward. Thus, when the cosmetic pad 930 come into contact with the top surface 811 of the applicator holder 810 or comes into slide contact with the top surface 811, the adhesion may be improved, and the content 1 discharged inside the rounded border 813 of the applicator holder 810 may not remain.

Figure 26:
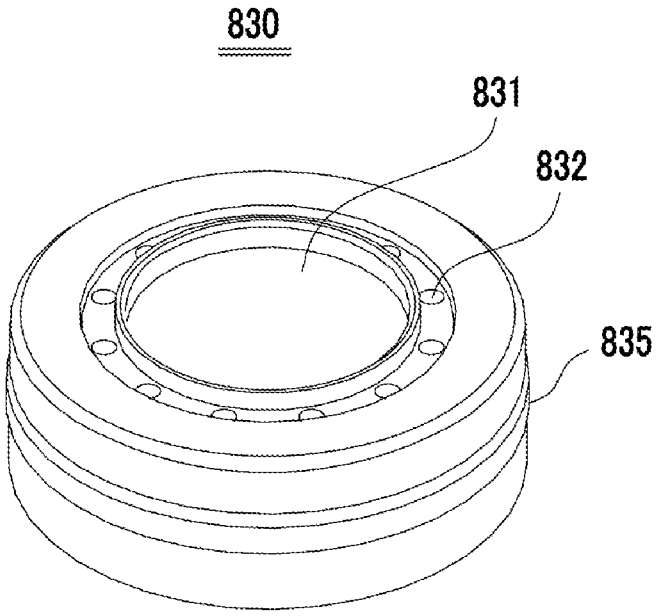
FIG. 26 is a perspective view of a magnet cover of FIG. 21.
Figure 27:
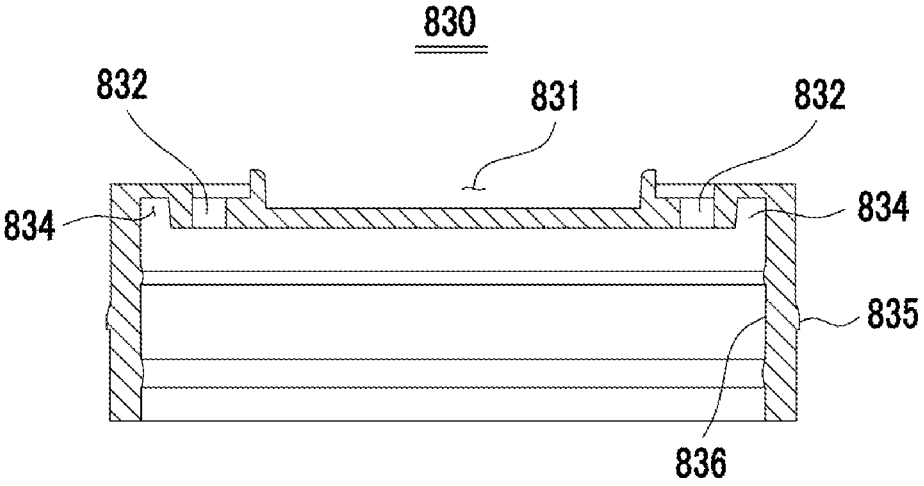
FIG. 27 is a longitudinal cross-sectional view of the magnet cover of FIG. 21.

FIG. 26 is a perspective view of a magnet cover of FIG. 21, and FIG. 27 is a longitudinal cross-sectional view of the magnet cover of FIG. 21.

As illustrated in FIGS. 26 and 27, the magnet cover 830 is inserted into and coupled to the inside of the magnet housing 815 to cover the first magnetic body 820 or the metal member. The magnet cover 830 has a circular tube shape with a top surface and an opened bottom surface. Also, the magnet cover 830 has an outer diameter corresponding to an inner diameter of the magnet housing 815 so that the magnet housing 815 is inserted therein.

Since a fixing protrusion 835 is disposed on an outer circumferential surface of the magnet cover 830 and inserted into a fixing groove 816 defined in an inner circumferential surface of the magnet housing 815, the magnet cover 830 may be fixedly coupled to the inside of the magnet housing 815.

Also, since a lower portion of the magnet cover 830 is inserted and coupled to the outside of the applicator holder coupling part 535 of the rotatable cap 530, the applicator holder 810 may be installed on an upper portion of the rotatable cap 530. For this, the magnet cover 830 may have an inner diameter corresponding to an outer diameter of the applicator holder coupling part 535 so that the magnet cover 830 is inserted and coupled to the outside of the applicator holder coupling part 535, and a fixing groove 836 is defined in the inner circumferential surface of the magnet cover 830 so that the fixing protrusion (see reference numeral 535*a* of FIG. 14) disposed on the outer circumferential surface of the applicator holder coupling part 535 is inserted into the fixing groove 836. Thus, the magnet cover 830 may be fixedly coupled to the outside of the applicator holder coupling part 535.

Also, the magnet cover 830 has a circular magnet seating groove 831 in a central portion of the top surface thereof to seat and support the lower portion of the first magnetic body 820 or the metal member, which is inserted into the first magnet insertion groove 814 of the applicator holder 810.

Also, a plurality of discharge connection holes 832 are connected to the nozzle hole 421*a* of the valve nozzle 420 through the discharge hole (see reference numeral 501 of FIG. 14) of the applicator holder coupling part 535 and defined in the top surface of the magnet cover 830 along an outer circumference of the magnet seating groove 831 to correspond to the fine discharge holes 812.

Figure 28:
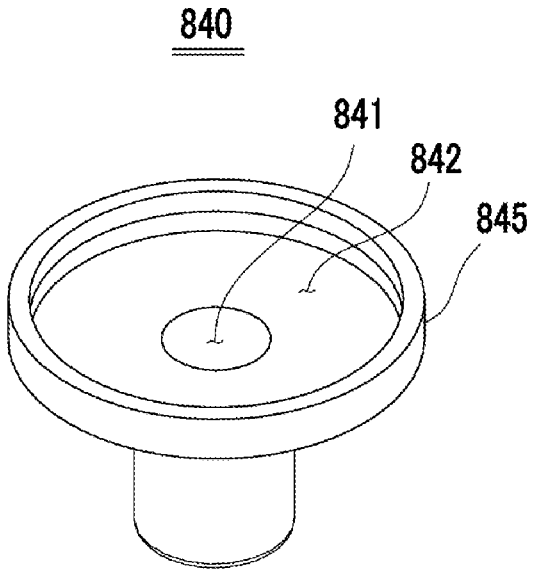
FIG. 28 is a perspective view of a sealing member of FIG. 21.
Figure 29:
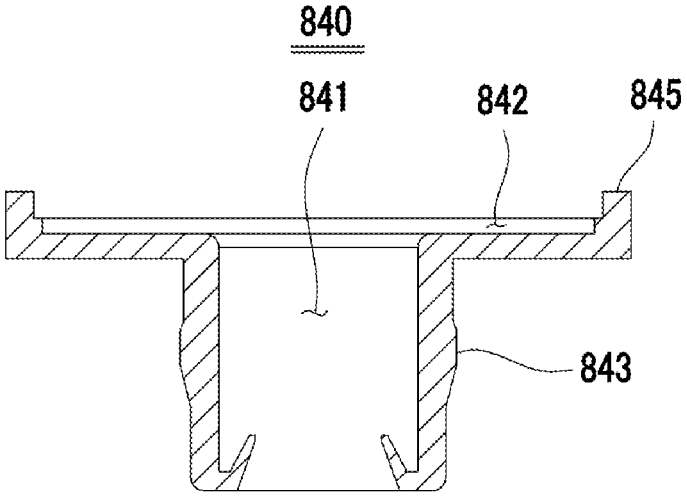
FIG. 29 is a longitudinal cross-sectional view of the sealing member of FIG. 21.

FIG. 28 is a perspective view of the sealing member of FIG. 21, and FIG. 29 is a longitudinal cross-sectional view of the sealing member FIG. 21.

As illustrated in FIGS. 28 and 29, the sealing member 840 has an upper portion inserted into and coupled to the inside of the magnet cover 830 and a lower portion inserted into the discharge hole 501 of the applicator holder coupling part 535 to form a through hole 841 in a central portion thereof. Thus, the upper end of the valve nozzle 420 may be inserted to pass through the through hole 841 of the sealing member 840, thereby preventing the liquid from leaking between the valve nozzle 420 and the discharge hole 501.

The upper portion of the sealing member 840 has a circular plate shape, and a rib protrusion 845 protruding upward is disposed on an edge of an outer circumferential surface of the sealing member and inserted into a rib groove 834 defined in an edge of an inner circumferential surface of a lower portion of the top surface of the magnet cover 830 to prevent the liquid from leaking between the sealing member 840 and the magnet cover 830 in the state in which the upper portion of the sealing member 840 is inserted into the magnet cover 830. Also, a passage groove 842 is defined by a predetermined depth in the circular plate top surface of the upper portion of the sealing member 840 to define a space due to the passage groove between the top surface of the magnet cover 830 and the circular plate when the rib protrusion 845 of the sealing member 840 is inserted into the rib groove 834 of the magnet cover 830. Thus, the content 1 discharged from the nozzle hole 421*a* of the valve nozzle 420 passing through the through hole 841 of the sealing member 840 may be introduced into the discharge connection hole 832 of the magnet cover 830 through the passage groove 842.

The sealing member 840 may have a lower portion having a hollow circular tube shape, and a hook protrusion 843 may be disposed on the outer circumferential surface of the sealing member 840 so that the hook protrusion 843 is hooked and fixed to a hook projection 536 disposed on an inner circumferential surface of the discharge hole 501 of the sealing insertion part 536.

Figure 30:
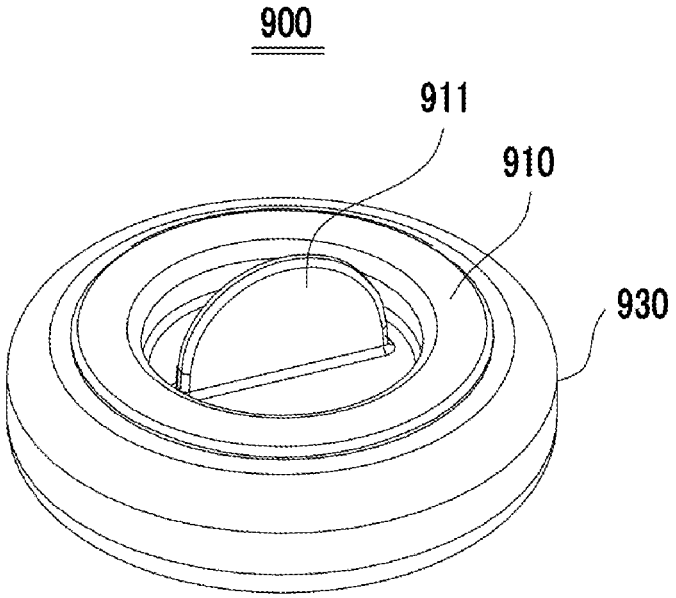
FIG. 30 is a perspective view of a cosmetic puff unit of FIG. 21.
Figure 31:
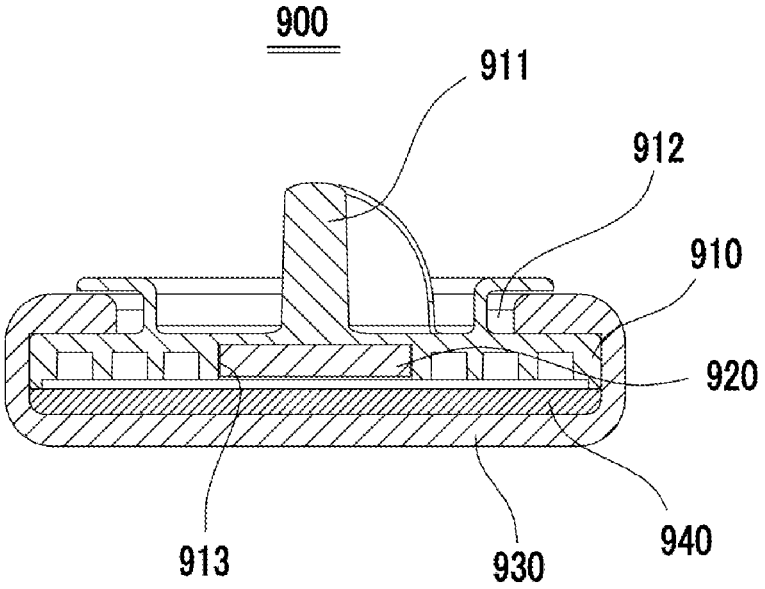
FIG. 31 is a longitudinal cross-sectional view of the cosmetic puff unit of FIG. 21.

FIG. 30 is a perspective view of the cosmetic puff unit of FIG. 21, and FIG. 31 is a longitudinal cross-sectional view of the cosmetic puff unit of FIG. 21.

As illustrated in FIGS. 30 and 31, the cosmetic puff unit 900 may includes a handle holder 910, a second magnetic body 920, a cosmetic pad 930, and a sponge pad 940.

The handle holder 910 has a circular plate shape corresponding to that of the applicator holder 810. It is preferable that the handle holder 910 has a diameter that is slightly less than that of the applicator holder 810.

A pad fitting groove 912 is defined along an outer circumferential surface of an upper portion of the handle holder 910 to allow an upper end of the cosmetic pad 930 to be fitted into and fixed to the pad fitting groove 912. Also, a handle 911 protrudes from the upper portion of the handle holder 910, and a second magnet insertion groove 913 having a circular shape is defined in a center of a lower portion of the handle holder 910 so that the second magnetic body 920 is inserted therein.

The second magnetic body 920 is inserted into the second magnet insertion groove 913 and has a magnet having a polarity opposite to that of the first magnetic body 820. For example, the first magnetic body 820 may include an N-pole magnet, or the second magnetic body 920 may include an S-pole magnet. On the other hand, the first magnetic body 820 may include an S-pole magnet, or the second magnetic body 920 may include an N-pole magnet. The cosmetic puff unit 900 may be attached to the applicator unit 800 by attractive force between the first magnetic body 820 and the second magnetic body 920 or between the metal member (not shown) and the second magnetic body 920.

The cosmetic pad 930 may be installed to surround the lower portion of the handle holder 910 in the state in which the second magnetic body 920 is inserted into the second magnet insertion groove 913. Here, an upper end of the cosmetic pad 930 may be fitted into and fixed to the pad fitting groove 912 of the handle holder 910. The cosmetic pad 930 comes into contact with the top surface of the applicator holder 810 to absorb the content 1 discharged through the fine discharge holes 812 of the applicator holder 810, thereby keeping the content 1 just as much as used when the makeup is performed.

It is preferable that the cosmetic pad 930 prevents the content from being volatilized to prevent the absorbed content 1 from being lost and is made of a ruby cell material having a superior application property when the makeup is performed.

The sponge pad 940 is inserted between the handle holder 910 and the cosmetic pad 930 and a circular plate shape corresponding to that of the handle holder 910. Also, the sponge pad 940 may be made of a sponge material to give electricity to the cosmetic pad 930 when the makeup is performed.

Figure 32:
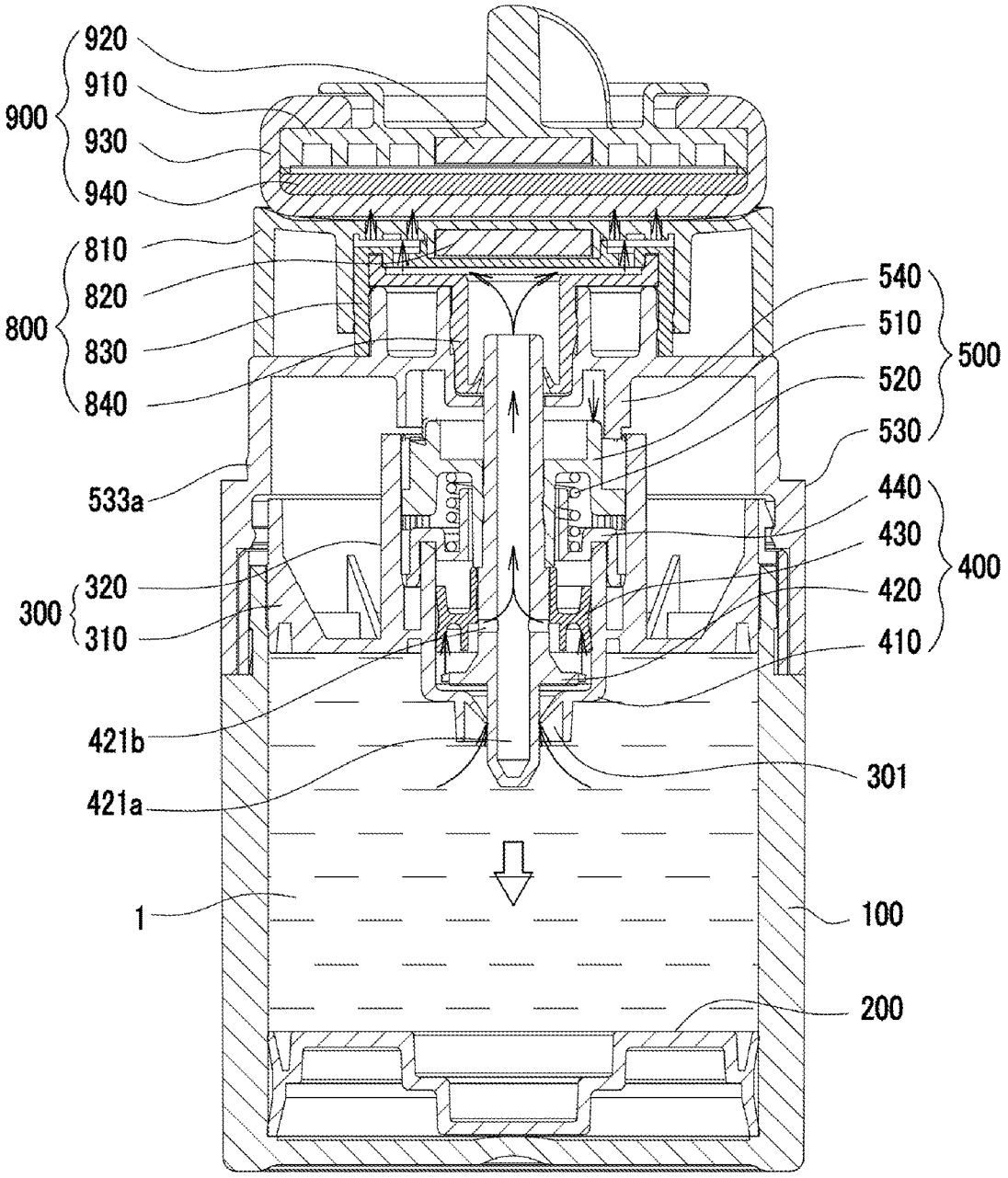
FIG. 32 is a view illustrating an operation state in which a content within the liquid cosmetics case is discharged according to another embodiment of the present invention.

FIG. 32 is a view illustrating an operation state in which the content within the liquid cosmetics case is discharged according to another embodiment of the present invention.

As illustrated in FIG. 32, when the user rotates the rotatable cap 530, the second cam part 540 integrally formed within the rotatable cap 530 is integrally rotated together with the rotatable cap 530. Thus, the cam protrusion 541 disposed on the inner surface of the second cam part 540 is rotated by being interlocked with the rotation of the second cam part 540 to come into contact with the upward inclined surface (see reference numeral 515*a* of FIG. 12) of the inclined protrusions (see reference numeral 515 of FIG. 12) disposed on the outer surface of the first cam part 510 in the rotation direction of the rotatable cap 530 and move the first cam part 510 downward. Here, since the rotation prevention protrusion (see reference numeral 517 of FIG. 12) disposed on the outer surface of the first cam part 510 moves along the elevation guide groove (see reference numeral 321 of FIG. 4) defined in the inner surface of the discharge tube 320, the first cam part 510 descends within the discharge tube 320 without being rotated.

In this process, the nozzle body 421 of the valve nozzle 420 fitted and coupled to the first cam part 510 moves downward, i.e., moves toward the discharge hole 301 by being interlocked with the descending of the first cam part 510. Here, the switching member 430 fitted and movably coupled to the outside of the nozzle body 421 is slid to a side opposite to the discharge hole 301 by a pressure of the content 1 introduced between the valve housing 410 and the nozzle body 421.

When the switching member 430 is slid to the side opposite to the discharge hole 301 to allow the clearance groove (see reference numeral 431*a* of FIG. 9) defined in the inside of the switching part (see reference numeral 431 of FIG. 9) to correspond to the inflow hole 421*b* defined in the nozzle body 421, the liquid content 1 is introduced into the nozzle hole 421*a* through the clearance groove 431*a* and the inflow hole 421*b*. The content 1 introduced into the nozzle hole 421*a* is introduced into the passage groove 842 through the through hole 841 of the sealing member 840 and then passes through the discharge connection hole 832 of the magnet cover 830 and is discharged through the plurality of fine discharge holes 812 defined in the applicator holder 810. The content discharged through the fine discharge holes 812 of the applicator holder 810 may be absorbed and kept in the cosmetic pad 930 coming into contact with the top surface 811 of the applicator holder 810 by just as much as used when the makeup is performed.

Also, in the state in which an amount of content 1 just as much as used is discharged, the cosmetic pad 930 may be touched with the content 1. Here, since the content 1 filled into the case body 100 is separated from the content 1 discharged to the outside of the case body 100, the pollution and the germ propagation of the content may be prevented.

Also, since the edge border 813 of the top surface of the applicator holder 810 is slightly rounded to form the curved surface, when the cosmetic pad 930 comes into contact with the top surface 811 of the applicator holder 810 or is slid and touched in the state of coming into contact with the top surface 811, the adhesion between the cosmetic pad 930 and the top surface 811 of the applicator holder 810 may be improved. In addition, the discharged content 1 may not remain within the rounded border 813 of the applicator holder 810 to always maintain the cleanliness of the applicator holder 810.

Figure 33:
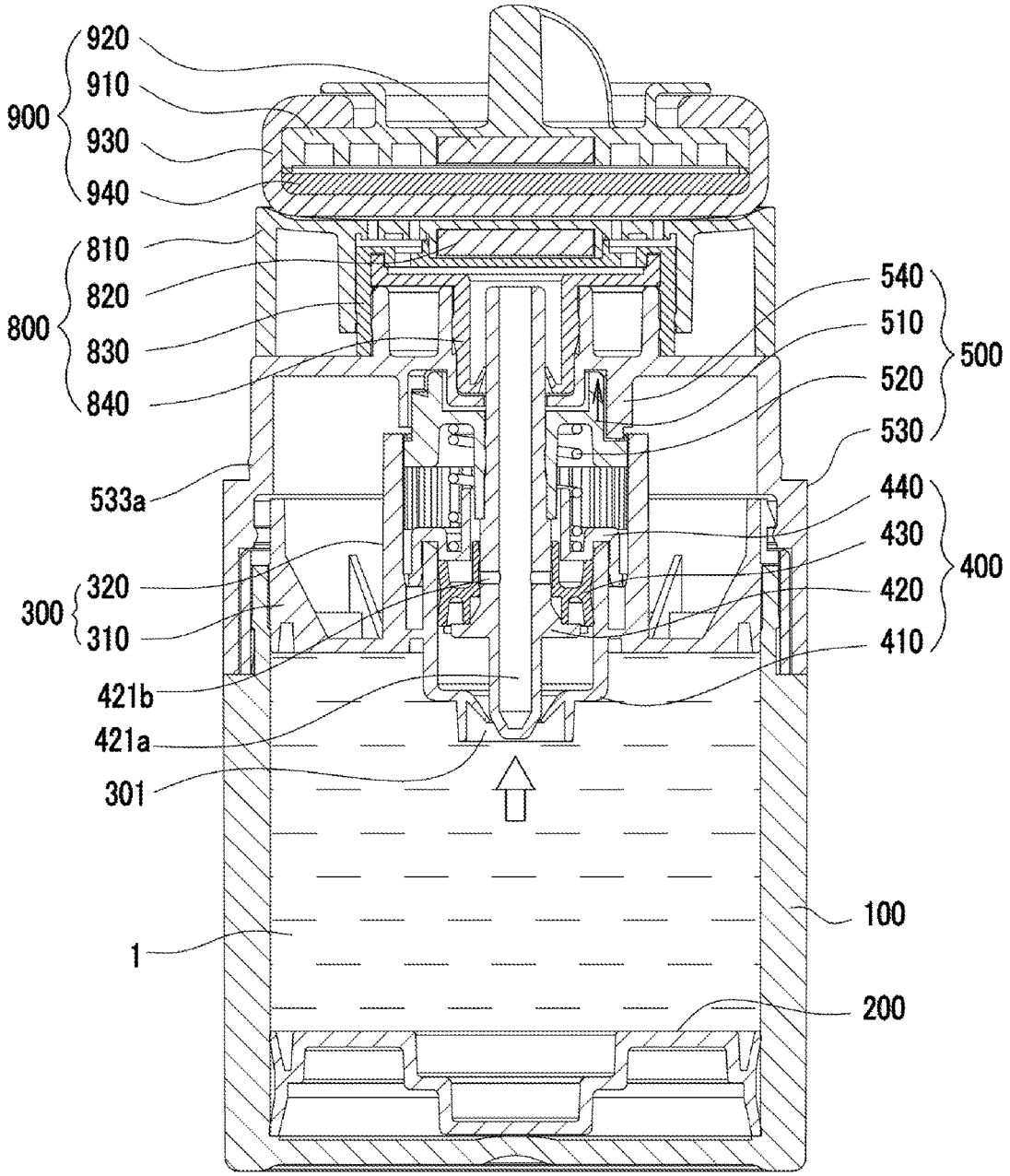
FIG. 33 is a view illustrating an operation state in which the discharge of the content within the liquid cosmetics case is blocked according to another embodiment of the present invention.

FIG. 33 is a view illustrating an operation state in which the discharge of the content within the liquid cosmetics case is blocked according to another embodiment of the present invention.

As illustrated in FIG. 33, when the first cam part 510 descends to open the valve unit 400, and then, the rotatable cap 530 is further rotated in a state in which the content 1 is discharged, the cam protrusion 541 of the second cam part 540 passes through the upward inclined surface (see reference numeral 515*a* of FIG. 12) to come into contact with the downward inclined surface (see reference numeral 515*b* of FIG. 12), and then, the first cam part 510 returns to its original state by restoring force of the spring 520 to move upward.

In this process, the nozzle body 421 of the valve nozzle 420 fitted and coupled to the first cam part 510 moves downward, i.e., moves toward the discharge hole 301 by being interlocked with the descending of the first cam part 510. When the nozzle body 421 moves to the side opposite to the discharge hole 301, i.e., when the nozzle body 421 ascends, the switching member 430 is pushed by the nozzle body 421 to return to its original state, thereby closing the inflow hole 421*b*. Thus, the discharge of the content 1 is stopped. Thus, in the state in which the discharge of the content 1 is stopped, the cosmetic puff unit 900 may be detachably installed on the upper portion of the applicator unit 800 by using the magnetic property to maintain the sealing of the fine discharge holes 812 through the applicator unit 800, thereby improving the sealability when attached. Thus, the volatilization of the content 1 may be prevented, and also, air may be blocked to prevent the content 1 from being acidified.

According to the liquid cosmetics case of the present invention, when the user rotates the rotatable cap of the case, the valve nozzle of the valve unit is elevated to open and close the discharge hole, thereby simply adjusting the discharging and blocking of the liquid content. Thus, the liquid cosmetics case may be very convenient in use.

Also, according to the present invention, since the valve type in which the discharge hole is opened and closed by the elevation of the valve nozzle is applied, the discharging portion may be always sealed on ordinary days. Thus, the liquid cosmetics case may have the superior sealability and be applied to all liquid contents regardless of the viscosity.

Also, according to the present invention, since the valve type is applied, the valve type liquid cosmetics case may be simplified in structure and have low manufacturing costs when compared to the existing button type and rotary type liquid cosmetics cases. In addition, the valve type liquid cosmetics case may be minimized in breakdown and malfunction.

Also, according to the present invention, since the second cam part for elevating the first cam part, to which the valve nozzle is coupled, is integrally formed within the rotatable cap, it may be unnecessary to manufacture the second cam part as a separate part, thereby reducing the number of parts. Also, the valve housing constituting the valve unit may be integrally formed within the discharge tube of the solder unit to reduce the number of parts of the valve unit. Thus, the number of parts may be reduced to realize the simple structure, resulting in reducing the manufacturing costs.

Also, according to the present invention, the applicator may be configured so that the content is finely discharged through the fine discharge hole of the cosmetic pad made of a ruby cell material in the state in which the absorption pad made of a sponge material absorbs the content to hold a predetermined amount of content to be used for the makeup. Thus, the user may easily apply the cosmetics and use the cosmetics without having the user's hand stained with the cosmetics.

Also, according to the present invention, the cosmetic puff unit may be detachably installed on the upper portion of the applicator unit by using the magnetic property to maintain the sealing of the fine discharge hole through the applicator unit, thereby improving the sealability when attached. Thus, the volatilization of the content may be prevented, and also, air may be blocked to prevent the content from being acidified.

Also, according to the present invention, in the state in which an amount of content just as much as used is discharged, the cosmetic pad may be touched with the content. Here, since the content filled into the case body is separated from the content discharged to the outside of the case body, the pollution and the germ propagation of the content may be prevented.

Also, according to the present invention, since the edge border of the top surface of the applicator holder is slightly rounded to form the curved surface, when the cosmetic pad comes into contact with the top surface of the applicator holder or is slid and touched in the state of coming into contact with the top surface, the adhesion between the cosmetic pad and the top surface of the applicator holder may be improved. In addition, the discharged content may not remain within the rounded border of the applicator holder to always maintain the cleanliness of the applicator holder.

Although the embodiment of the present invention is described with reference to the accompanying drawings, those with ordinary skill in the technical field of the present invention pertains will be understood that the present invention can be carried out in other specific forms without changing the technical idea or essential features. Thus, the above-disclosed embodiments are to be considered illustrative and not restrictive. Accordingly, the scope of the present invention is defined by the appended claims rather than the foregoing description and the exemplary embodiments described therein. Various modifications made within the meaning of an equivalent of the claims of the invention and within the claims are to be regarded to be in the scope of the present invention.

What is claimed is:

1. A liquid cosmetics case comprising:

a case body having an opened upper portion and filled with a liquid content therein;

a solder unit coupled to the opened upper portion of the case body and having a discharge tube, in which a discharge hole is defined, in a central portion thereof;

a valve unit comprising:

a valve housing;

a valve nozzle;

a switching member; and a valve cap;

the valve unit inserted into the discharge tube to open or close the discharge hole according to elevation of the valve nozzle;

the valve housing extending in a circular tube shape with an opened upper portion and integrated with an inner lower portion of the discharge tube and having a lower end communicating with the discharge hole;

the valve nozzle installed vertically movable by passing through the discharge hole in a state of being inserted into the valve housing, having a nozzle hole therein and an inflow hole, which is connected to the nozzle hole to introduce the content into the nozzle hole, in a side thereof;

the switching member movably fitted outside the valve nozzle, wherein, when the valve nozzle moves toward the discharge hole, the switching member is pushed to a side opposite to the discharge hole by a pressure of the content introduced between the valve housing and the valve nozzle, and when the valve nozzle moves toward a side opposite to the discharge hole, the switching member is pushed by the valve nozzle to return its original state; and the valve cap coupled to the valve housing to pass through an upper portion of the valve nozzle;

a valve actuator unit rotatably coupled to an upper portion of the solder unit to convert the rotation movement into a vertical linear movement of the valve nozzle and open or close the discharge hole, wherein, when the valve nozzle descends by the rotation, the valve actuator unit opens the discharge hole to discharge the content, and when the valve nozzle ascends, the valve actuator unit closes the discharge hole to block the discharge of the content; and an applicator unit coupled to an upper end of the valve actuator unit to discharge the content discharged by the rotation of the valve actuator unit through a plurality of fine discharge holes.

2. The liquid cosmetics case of claim 1, wherein the solder unit comprises:

a solder body fitted and coupled to the outside of an upper end of the case body;

wherein the discharge tube has a circular tube shape with an opened upper portion in the central portion of the solder body, and a lower portion in which the discharge hole is defined.

3. The liquid cosmetics case of claim 1, wherein the valve actuator unit comprises:

a first cam part, which is fitted into an upper portion of the valve cap, through which the valve nozzle passes a central portion thereof, and in which a plurality of inclined sawteeth at a predetermined interval on an outer surface thereof along a circumferential direction;

an elastic member installed to elastically support the first cam part with respect to the valve cap; and a rotatable cap, which is rotatably fitted and coupled outside the solder unit, in which an upper end of the valve nozzle passes through a central portion to a top surface thereof, and which has a circular tube shape in an inner lower portion of the central portion of the top surface thereof and is integrated with a second cam part having a plurality of cam protrusions at a predetermined interval on an inner surface thereof along a circumferential direction to correspond to the inclined sawteeth, wherein, when the rotatable cap is rotated, the cam protrusions of the second cam part are rotated to vertically move the first cam part by the inclined contact with the inclined sawteeth of the first cam part and elevate the valve nozzle connected to the first cam part, thereby opening or closing the discharge hole.

4. The liquid cosmetics case of claim 3, wherein each of the inclined sawteeth has an upward inclined surface and a downward inclined surface with respect to the rotation direction of the rotatable cap, and when the rotatable cap is rotated, the cam protrusions of the second cam part come into contact with the upward inclined surface and move the first cam part downward to open the discharge hole while the valve nozzle moves toward the discharge hole, and the cam protrusions of the second cam part pass through the upward inclined surface to come into contact with the downward inclined surface and move the first cam part upward, thereby closing the discharge hole while the valve nozzle moves to a side opposite to the discharge hole.

5. The liquid cosmetics case of claim 3, wherein at least one rotation prevention protrusion protrudes from an outer surface of the first cam part, and at least one elevation guide groove is defined in an inner surface of the discharge tube of the solder unit in a longitudinal direction so that the rotation prevention protrusion is inserted into the elevation guide groove, and when the rotatable cap is rotated, the rotation prevention protrusion moves along the elevation guide groove and is elevated to move within the discharge tube without rotating the first cam part.

6. The liquid cosmetics case of claim 3, wherein the rotatable cap comprises:

a rotation coupling part having a hollow circular tube shape and rotatably fitted and coupled outside of the solder unit;

a lid coupling part which extends from an upper end of the rotation coupling part and has inner and outer diameters less than those of the rotation coupling part and in which a case lid is detachably fitted into an outer surface thereof; and an applicator holder coupling part which extends to protrude from a top surface of the lid coupling part and has a discharge hole in a central portion thereof and in which an applicator holder is detachably fitted into an outer surface thereof;

wherein the second cam part is integrally formed in a circular tube shape on an inner lower portion of a central portion of the top surface of the lid coupling part.

7. The liquid cosmetics case of claim 6, wherein the rotatable cap further comprises a sealing member inserted into and coupled to the discharge hole of the applicator holder coupling part and having a through hole in a central portion thereof, wherein the upper end of the valve nozzle is inserted to pass through the through hole of the sealing member, thereby preventing a liquid from leaking between the valve nozzle and the discharge hole by the sealing member.

8. The liquid cosmetics case of claim 7, wherein the applicator unit comprises:

an applicator holder fitted into and coupled to the applicator holder coupling part and having a discharge hole in a central portion thereof so as to be connected to the nozzle hole of the valve nozzle through the through hole of the sealing member;

an absorption pad installed on a top surface of the applicator holder to absorb and keep the content discharged through the discharge hole of the applicator holder; and a cosmetic pad fixed to the applicator holder in a state of covering a top surface of the absorption pad and having a plurality of fine discharge holes to finely discharge the content absorbed to the absorption pad.

9. The liquid cosmetics case of claim 6, further comprising a cosmetic puff unit detachably installed on an upper portion of the applicator unit by a magnetic property to maintain sealing of the fine discharge holes of the applicator unit when attached by the magnetic property.

10. The liquid cosmetics case of claim 9, wherein a first magnetic body or a metal member is built in the applicator unit, and a second magnetic body is built in the cosmetic puff unit to allow the cosmetic puff unit to be attached to the applicator unit by magnetic attractive force between the first magnetic body and the second magnetic body or between the metal member and the second magnetic body.

11. The liquid cosmetics case of claim 10, wherein the applicator unit comprises:

an applicator holder, which is installed on an upper portion of the rotatable cap and comprises a cylindrical magnetic housing having a first magnet insertion groove in a center of a lower portion of a top surface thereof and in which a plurality of fine discharge holes passing through a top surface of the magnet housing, wherein the first magnetic body or the metal member is inserted into the first magnet insertion groove; and a magnet cover, which has an upper portion inserted and coupled inside the magnet housing to cover the first magnetic body or the metal member and a lower portion inserted and coupled outside the applicator holder coupling part and in which a plurality of discharge connection holes in a top surface thereof to correspond to the fine discharge holes while being connected to the nozzle hole of the valve nozzle through the through hole of the applicator holder coupling part.

12. The liquid cosmetics case of claim 11, wherein the applicator unit further comprises a sealing member, which has an upper portion inserted inside the magnet cover and a lower portion inserted into the discharge hole of the applicator holder coupling part and in which a through hole is defined in a central portion thereof, and the upper end of the valve nozzle is inserted to pass through the through hole of the sealing member to prevent the liquid from leaking between the valve nozzle and the discharge hole.

13. The liquid cosmetics case of claim 11, wherein the cosmetic puff unit comprises:

a handle holder in which a handle is disposed on an upper portion thereof, and a second magnet insertion groove is defined in a center of a lower portion thereof; and a cosmetic pad installed to surround the lower portion of the handle holder in a state in which the second magnetic body is inserted into the second magnet insertion groove and coming into contact with a top surface of the applicator holder to absorb and keep the content discharged through the fine discharge holes.

14. The liquid cosmetics case of claim 13, wherein an edge of a border of a top surface of the applicator holder has a rounded curve to correspond to a curve of an edge of a bottom surface of the cosmetic pad to improve adhesion when coming into contact with the cosmetic pad and prevent the discharged content from remaining on the rounded border of the applicator holder.

* * * * *